US007775067B2

(12) United States Patent
Ichiyanagi

(10) Patent No.: US 7,775,067 B2
(45) Date of Patent: Aug. 17, 2010

(54) HEAT EXCHANGER HEADER TANK AND HEAT EXCHANGER COMPRISING SAME

(75) Inventor: Shigeharu Ichiyanagi, Oyama (JP)

(73) Assignee: Showa Denko K.K., Tokyo (JP)

( * ) Notice: Subject to any disclaimer, the term of this patent is extended or adjusted under 35 U.S.C. 154(b) by 1092 days.

(21) Appl. No.: 10/583,764

(22) PCT Filed: Mar. 17, 2005

(86) PCT No.: PCT/JP2005/005462

§ 371 (c)(1),
(2), (4) Date: Jun. 21, 2006

(87) PCT Pub. No.: WO2005/088225

PCT Pub. Date: Sep. 22, 2005

(65) Prior Publication Data

US 2009/0266104 A1 Oct. 29, 2009

Related U.S. Application Data

(60) Provisional application No. 60/555,705, filed on Mar. 24, 2004, provisional application No. 60/655,426, filed on Feb. 24, 2005.

(30) Foreign Application Priority Data

Mar. 17, 2004 (JP) ..... 2004-076763
Feb. 18, 2005 (JP) ..... 2005-042641

(51) Int. Cl.
*F25B 39/02* (2006.01)

(52) U.S. Cl. ..... 62/515; 62/507; 165/173; 165/174; 165/175; 165/176

(58) Field of Classification Search ..... 62/507, 62/515; 165/153, 175, 173, 174, 176; 29/890.052, 29/890.043, 890.04, 890.039, 890.03
See application file for complete search history.

(56) References Cited

U.S. PATENT DOCUMENTS 4,971,145 A * 11/1990 Lyon ..... 165/173

(Continued)

FOREIGN PATENT DOCUMENTS

JP 2001-133189 5/2001

(Continued)

OTHER PUBLICATIONS

U.S. Appl. No. 10/588,209, filed Aug. 2, 2006, Ichiyanagi.

*Primary Examiner*—Cheryl J Tyler
*Assistant Examiner*—Justin Loffredo
(74) *Attorney, Agent, or Firm*—Oblon, Spivak, McClelland, Maier & Neustadt, L.L.P.

(57) ABSTRACT

A heat exchanger has header tanks each including a header forming plate, a tube connecting plate, and an intermediate plate interposed between the two plates, the plates being arranged in superposed layers and brazed to one another. Each of the plates is made from a metal plate by press work. The header forming plate has an outward bulging portion. The tube connecting plate has tube insertion holes. The intermediate plate has communication holes causing tube insertion holes to communicate with the interior of each outward bulging portion therethrough. Heat exchange tubes have opposite ends placed into the respective insertion holes and brazed to the respective tube connecting plates. The heat exchanger including such header tanks is reduced in the number of components, can be fabricated with a high work efficiency, and exhibits improved heat exchange performance.

10 Claims, 23 Drawing Sheets

U.S. PATENT DOCUMENTS

| | | | | |
|---|---|---|---|---|
| 5,381,858 | A * | 1/1995 | Fredrich | 165/79 |
| 6,581,679 | B2 * | 6/2003 | Fischer et al. | 165/174 |
| 7,481,266 | B2 * | 1/2009 | Demuth et al. | 165/176 |
| 2002/0134538 | A1 * | 9/2002 | Moreau | 165/173 |
| 2003/0188857 | A1 * | 10/2003 | Kawakubo et al. | 165/174 |
| 2004/0159121 | A1 * | 8/2004 | Horiuchi et al. | 62/526 |
| 2007/0131391 | A1 * | 6/2007 | Ichiyanagi | 165/110 |

FOREIGN PATENT DOCUMENTS

| | | |
|---|---|---|
| JP | 2003-519356 | 6/2003 |
| JP | 2003-314987 | 11/2003 |

* cited by examiner

HEAT EXCHANGER HEADER TANK AND HEAT EXCHANGER COMPRISING SAME

CROSS REFERENCE TO RELATED APPLICATION

This application is an application filed under 35 U.S.C. §111(a) claiming the benefit pursuant to 35 U.S.C. §119(e)(1) of the filing dates of Provisional Applications No. 60/555,705 filed Mar. 24, 2004 and No. 60/655,426 filed Feb. 24, 2005 pursuant to 35 U.S.C. §111(b).

TECHNICAL FIELD

The present invention relates to heat exchanger header tanks and heat exchangers comprising the header tank, and more particularly to header tanks for use in heat exchangers, such as gas coolers or evaporators of supercritical refrigeration cycles wherein a $CO_2$ (carbon dioxide) refrigerant or like supercritical refrigerant is used, and heat exchangers.

The term "aluminum" as used herein and in the appended claims includes aluminum alloys in addition to pure aluminum.

BACKGROUND ART

Already known for use in supercritical refrigeration cycles is a heat exchanger comprising a pair of header tanks arranged as spaced apart from each other, heat exchange tubes arranged in parallel at a spacing between the pair of headers and having opposite ends joined to the respective headers, and fins arranged in respective air passing clearances between respective adjacent pairs of heat exchange tubes and each joined to the tubes adjacent thereto, each of the header tanks comprising a header member in the form of a major arc in cross section, a pipe connecting plate having tube inserting slits extending through the thickness thereof and arranged longitudinally thereof at a spacing, the connecting plate being in the form of a minor arc in cross section for closing a longitudinal opening of the header member, an intermediate plate disposed inwardly of the tube connecting plate and extending therealong, the intermediate plate having a plurality of communication holes extending therethrough and arranged longitudinally thereof at a spacing for holding the respective tube inserting slits in communication with the interior of the header member therethrough, and caps closing respective opposite end openings (see the publication of JP-A No. 2001-133189, FIGS. 1 to 5).

However, the header tank included in the heat exchanger of the publication requires caps for closing opposite end openings and therefore has the problem of necessitating an increased number of components and being low in the efficiency of work for joining the caps to the header member, pipe connecting plate and intermediate plate. Additionally, the caps must be made as separate members and are cumbersome to make.

To improve the heat exchanger disclosed in the publication in heat exchange performance, it is desirable to change the course of flow of the refrigerant, for example, by dividing the interior of at least one of the header tanks with a partition, whereas this entails the problem that the provision of the partition requires a cumbersome procedure.

An object of the present invention is to overcome the above problems and to provide a heat exchanger header tank which is smaller in the number of components, can be fabricated by more efficient work and is capable of giving a higher heat exchange efficiency to heat exchangers than the conventional heat exchanger header tank, and a heat exchanger comprising the header tank.

DISCLOSURE OF THE INVENTION

To fulfill the above object, the present invention comprises the following modes.

1) A heat exchanger header tank comprising a header forming plate, a tube connecting plate and an intermediate plate interposed between the two plates, the header forming plate, the tube connecting plate and intermediate plate being arranged in superposed layers and brazed to one another, the header forming plate being provided with an outward bulging portion extending longitudinally thereof and having an opening thereof closed with the intermediate plate, the tube connecting plate being provided at a portion thereof corresponding to the outward bulging portion with a plurality of tube insertion holes arranged longitudinally of the tube connecting plate at a spacing and extending through the thickness thereof, the intermediate plate having communication holes extending through the thickness thereof for causing the respective tube insertion holes of the tube connecting plate to communicate with interior of the outward bulging portion of the header forming plate therethrough.

2) A heat exchanger header tank according to par. 1) wherein the header forming plate, the tube connecting plate and the intermediate plate are each made from a metal plate by press work.

3) A heat exchanger header tank according to par. 1) wherein the tube connecting plate is integrally provided at each of opposite side edges thereof with a cover wall covering a boundary between the header forming plate and the intermediate plate over the entire length thereof, and the cover wall is brazed to corresponding side faces of the header forming plate and the intermediate plate.

4) A heat exchanger header tank according to par. 3) wherein the cover plate is integrally provided at an outer end thereof with an engaging portion engaged with an outer surface of the header forming plate and brazed to the header forming plate.

5) A heat exchanger header tank according to par. 1) wherein the header forming plate has one outward bulging portion, and all the communication holes of the intermediate plate are held in communication by communication portions formed in the intermediate plate.

6) A heat exchanger header tank according to par. 1) wherein the header forming plate has a plurality of outward bulging portions aligned longitudinally thereof and spaced apart from each other, and all the communication holes of the intermediate plate communicating with each of the outward bulging portions are held in communication by communication portions formed in the intermediate plate.

7) A heat exchanger header tank according to par. 1) wherein the header forming plate has a plurality of outward bulging portions arranged widthwise thereof and spaced apart from each other, and all the communication holes of the intermediate plate communicating with each of the outward bulging portions are held in communication by communication portions formed in the intermediate plate.

8) A heat exchanger header tank according to par. 1) wherein the header forming plate has a plurality of outward bulging portions arranged longitudinally and widthwise thereof and spaced from one another, and the communication holes of the intermediate plate communicating with at least one group of outward bulging portions arranged in the widthwise direction are held in communication by first communication portions formed in the intermediate plate to thereby cause the outward bulging portions of the group to communicate with one another, all the communication holes of the intermediate plate communicating with the other outward bulging portions being held in communication by second communication holes formed in the intermediate plate.

9) A heat exchanger comprising a pair of header tanks arranged as spaced apart from each other, and a plurality of heat exchange tubes arranged in parallel between the pair of header tanks and each having opposite ends joined to the respective header tanks, each of the heat exchanger header tanks comprising a header forming plate, a tube connecting plate and an intermediate plate interposed between the two plates, the header forming plate, the tube connecting plate and intermediate plate being arranged in superposed layers and brazed to one another, the header forming plate being provided with an outward bulging portion extending longitudinally thereof and having an opening thereof closed with the intermediate plate, the tube connecting plate being provided at a portion thereof corresponding to the outward bulging portion with a plurality of tube insertion holes arranged longitudinally of the tube connecting plate at a spacing and extending through the thickness thereof, the intermediate plate having communication holes extending through the thickness thereof for causing the respective tube insertion holes of the tube connecting plate to communicate with interior of the outward bulging portion of the header forming plate therethrough, the heat exchange tubes having their opposite ends inserted into the respective tube insertion holes of the pair of header tanks and brazed to the respective header tanks.

10) A heat exchanger according to par. 9) wherein the header forming plate, the tube connecting plate and the intermediate plate are each made from a metal plate by press work.

11) A heat exchanger according to par. 9) wherein the tube connecting plate is integrally provided at each of opposite side edges thereof with a cover wall covering a boundary between the header forming plate and the intermediate plate over the entire length thereof, and the cover wall is brazed to corresponding side faces of the header forming plate and the intermediate plate.

12) A heat exchanger according to par. 11) wherein the cover plate is integrally provided at an outer end thereof with an engaging portion engaged with an outer surface of the header forming plate and brazed to the header forming plate.

13) A heat exchanger according to par. 9) wherein the header forming plate of the first of the pair of header tanks has a plurality of outward bulging portions aligned longitudinally thereof and spaced apart from each other, and the header forming plate of the second of the pair of header tanks has outward bulging portions one smaller in number to the number of outward bulging portions of the first header tank so as to be opposed to adjacent two outward bulging portions of the first header tank, all the communication holes of the intermediate plate of the first header tank in communication with each of the outward bulging portions of the first header tank being held in communication by communication portions formed in the intermediate plate, all the communication holes of the intermediate plate of the second header tank in communication with each of the outward bulging portions of the second header tank being held in communication by communication portions formed in the intermediate plate, the first header tank having a refrigerant inlet communicating with the outward bulging portion at one end thereof and a refrigerant outlet communicating with the outward bulging portion at the other end thereof.

14) A heat exchanger according to par. 13) wherein the first header tank is two in the number of outward bulging portions therein, and the second header tank is one in the number of outward bulging portion therein.

15) A heat exchanger according to par. 13) wherein assuming that the header forming plate of each of the header tanks has a wall thickness T and that the outward bulging portion of each header tank has a bulging height of H, H/T is in the range of 0.5 to 1.5.

16). A heat exchanger according to par. 9) wherein the header forming plate of the first of the pair of header tanks has four outward bulging portions arranged widthwise thereof at a spacing and longitudinally thereof at a spacing, and the header forming plate of the second of the pair of header tanks has two outward bulging portions arranged side by side as spaced apart widthwise thereof and opposed to the respective longitudinally adjacent pairs of outward bulging portions of the first header tank, the tube connecting plate of each of the header tanks being provided with a plurality of tube insertion holes at each of widthwise opposite side portions thereof, the intermediate plate of each header tank being provided with a plurality of communication holes at each of widthwise opposite side portions thereof, the communication holes of the intermediate plate of the first header tank in communication with one of the pair of outward bulging portions arranged widthwise of the first header tank and the communication holes of the intermediate plate in communication with the other outward bulging portion of said pair being held in communication by first communication holes formed in the intermediate plate to thereby cause said pair of outward bulging portions to communicate with each other, all the communication holes of the intermediate plate communicating with the other pair of outward bulging portions being held in communication by second communication portions formed in the intermediate plate, all the communication holes of the intermediate plat of the second header tank in communication with each of the outward bulging portions of the second header tank being held in communication by communication portions formed in the intermediate plate, the first header tank being provided with a refrigerant inlet communicating with one of said other pair of outward bulging portions and a refrigerant outlet communicating with the other outward bulging portion of said other pair.

17) A heat exchanger according to par. 16) wherein assuming that the header forming plate of each of the header tanks has a wall thickness T and that the outward bulging portions of each header tank have a bulging height of H, H/T is in the range of 1.0 to 2.0.

18) A process for fabricating a heat exchanger characterized by subjecting a brazing sheet having a brazing material layer over at least one surface thereof to press work to make a header forming plate having an outward bulging portion with an inner surface thereof covered with the brazing material layer, making a tube connecting plate having a plurality of tube insertion holes arranged longitudinally thereof at a spacing, a cover plate integral with each of opposite side edges thereof and extending over the entire length thereof and an engaging portion forming lug integral with an outer end of the cover wall, by subjecting a brazing sheet having a brazing material layer over opposite surfaces thereof to press work, making an intermediate plate having a plurality of communication holes arranged longitudinally thereof at a spacing by subjecting a bare metal material to press work, making two tacked assemblies each by arranging the three plates in superposed layers with the intermediate plate positioned in the middle, inwardly bending the engaging portion forming lug to form an engaging portion and causing the engaging portion to engage with the header forming plate to tack the three plates, preparing a plurality of heat exchange tubes and fins, arranging the two tacked assemblies as spaced apart with the tube connecting plates opposed to each other, alternately arranging the heat exchange tubes and the fins, placing opposite ends of the heat exchange tubes into the respective tube insertion holes of the tube connecting plates of the two tacked assemblies, and brazing the three plates of each of the tacked assemblies to one another to make header tanks, brazing the cover wall of each tacked assembly to corresponding side faces of the header forming plate and the intermediate plate thereof and the engaging portion thereof to the header forming plate, and brazing the heat exchange tubes to the header tanks and each of the fins to the heat exchange tubes adjacent thereto at the same time.

19) A supercritical refrigeration cycle which comprises a compressor, a gas cooler, an evaporator, a pressure reducing device and an intermediate heat exchanger for subjecting refrigerant flowing out from the gas cooler and refrigerant flowing out from the evaporator to heat exchange, and wherein a supercritical refrigerant is used, the gas cooler comprising a heat exchanger according to any one of pars. 13) to 15).

20) A supercritical refrigeration cycle which comprises a compressor, a gas cooler, an evaporator, a pressure reducing device and an intermediate heat exchanger for subjecting refrigerant flowing out from the gas cooler and refrigerant flowing out from the evaporator to heat exchange, and wherein a supercritical refrigerant is used, the evaporator comprising a heat exchanger according to par. 16) or 17).

21) A vehicle having installed therein a supercritical refrigeration cycle according to par. 19) as a vehicle air conditioner.

22) A vehicle having installed therein a supercritical refrigeration cycle according to par. 20) as a vehicle air conditioner.

With the heat exchanger header tank according to par. 1), the header forming plate has an outward bulging portion extending longitudinally thereof and having an opening closed with the intermediate plate. This eliminates the need to use caps for closing opposite end openings unlike the header tank of the above-mentioned publication. As a result, the components can be smaller in number, while the work for joining the caps becomes unnecessary, further obviating the work for making the caps as separate members.

If the header forming plate is provided with a plurality of outward bulging portions, such header tanks, when in a suitable combination, make it possible to cause the refrigerant to flow through the heat exchanger in a direction favorable for an improvement in heat exchange performance, without necessitating other members such as partitions.

With the heat exchanger header tank described in par. 2), the header forming plate having a bulging portion, the tube connecting plate having tube insertion holes and the intermediate plate having communication holes are each made from a metal plate by press work. This serves to shorten the working time and decrease the number of working steps.

With heat exchanger header tank according to par. 3), the leakage of refrigerant through the boundary between the header forming plate and the intermediate plate can be prevented by the cover wall.

With the heat exchanger header tank described in par. 4), the three plates to be brazed can be tacked with the engaging portions. This eliminates the need for an additional tacking jig.

With the heat exchanger header tank according to par. 5), the intermediate plate is also provided with a channel for allowing the refrigerant to flow longitudinally of the header tank. The channel is combined with the outward bulging portion to provide a flow channel of increased cross sectional area.

The heat exchanger header tanks described in pars. 6) to 8), when used in a suitable combination, make it possible to cause the refrigerant to flow through the heat exchanger in a direction favorable for an improvement in heat exchange performance, without necessitating other members such as partitions.

The heat exchanger according to par. 9) obviates the need for caps for closing opposite end openings unlike the header tank disclosed in the foregoing publication. This reduces the number of components and eliminates the need for the work for joining the caps. Additionally, the work for making separate caps can be dispensed with.

Further if at least one of the header forming plates is provided with a plurality of outward bulging portions, the refrigerant can be caused to flow through the heat exchanger in a direction favorable for an improvement in heat exchange performance, without necessitating other members such as partitions.

With the heat exchanger described in par. 10), the header forming plate having a bulging portion, the tube connecting plate having tube insertion holes and the intermediate plate having communication holes are each made from a metal plate by press work. This serves to shorten the working time and decrease the number of working steps.

The heat exchanger according to par. 11) has cover walls for preventing the leakage of refrigerant through the boundary between the header forming plate and the intermediate plate.

With the heat exchanger described in par. 12), the three plates to be brazed can be tacked with the engaging portions. This eliminates the need for an additional tacking jig.

The heat exchanger according to pars. 13) and 14) enables the refrigerant to flow favorably to achieve an improved heat exchange efficiency. Accordingly, when used as a gas cooler for supercritical refrigerant cycles, the heat exchanger exhibits improved heat exchange performance.

With the heat exchanger according to par. 15), the outward bulging portions can be given a flow channel of suitable cross sectional area in the case where the heat exchanger is used, for example, as a gas cooler for supercritical refrigeration cycles.

The heat exchanger according to par. 16) enables the refrigerant to flow favorably to achieve an improved heat exchange efficiency. For example, when used as an evaporator for supercritical refrigerant cycles, the heat exchanger exhibits improved heat exchange performance.

With the heat exchanger according to par. 17), the outward bulging portions can be given a flow channel of suitable cross sectional area in the case where the heat exchanger is used, for example, as an evaporator for supercritical refrigeration cycles.

The heat exchanger fabrication process according to par. 18) provides heat exchangers according to pars. 8) to 17). Since the three plates can be tacked with the engaging portions, there is no need to use an additional tacking jig.

BEST MODE OF CARRYING OUT THE INVENTION

Embodiments of the present invention will be described below with reference to the drawings.

In the following description, the upper, lower, left-hand and right-hand sides of FIGS. 1, 2, 10 and 11 will be referred to as "upper," "lower," "left" and "right," respectively. Further the downstream side of flow of air through an air passing clearance between each adjacent pair of heat exchange tubes will be referred to as the "front," and the opposite side as the "rear."

Embodiment 1

This embodiment is shown in FIGS. 1 to 9 and is a gas cooler for supercritical refrigeration cycles which comprises a heat exchanger of the present invention.

Figure 1:
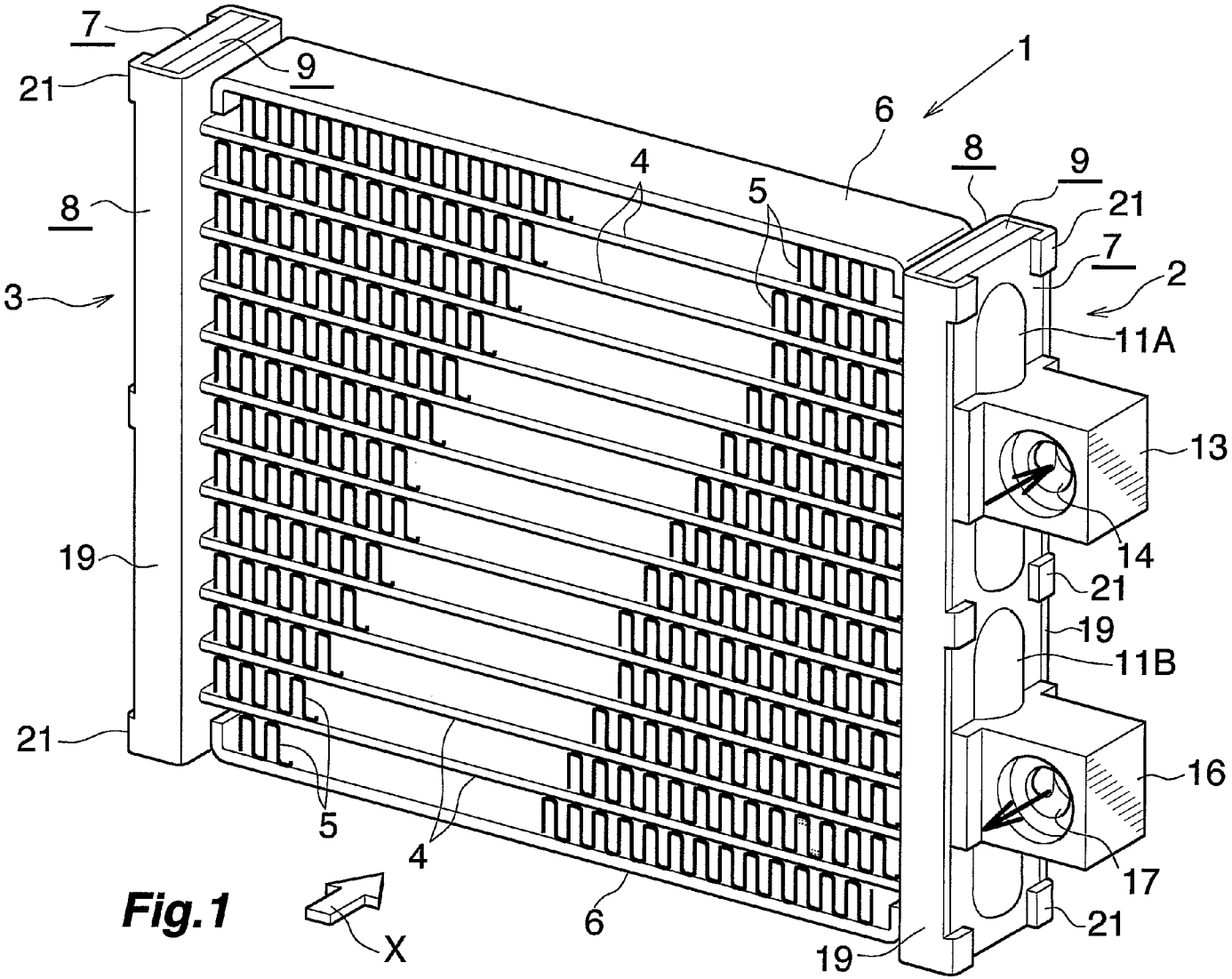
FIG. 1 is a perspective view showing the overall construction of a heat exchanger of the invention for use as a gas cooler.

With reference to FIG. 1, the gas cooler 1 for use in supercritical refrigeration cycles wherein a supercritical refrigerant, such as $CO_2$, is used comprises two header tanks 2, 3 extending upward or downward and arranged as spaced part in the left-right direction, a plurality of flat heat exchange tubes 4 arranged one above another at a spacing in parallel between the two header tanks 2, 3, corrugated fins 5 arranged in respective air passing clearances between respective adjacent pairs of heat exchange tubes 4 and outside the heat exchange tubes 4 at the upper and lower ends of the cooler and each brazed to the adjacent pair of heat exchange tubes 4 or to the end tube 4, and side plates 6 of bare aluminum material arranged externally of and brazed to the respective fins 5 at the upper and lower ends. In the case of this embodiment, the header tank 2 at the right will be referred to as the "first header tank," and the header tank 3 at the left as the "second header tank."

With reference to FIGS. 2 to 6, the first header tank 2 comprises a header forming plate 7 made from a brazing sheet having a brazing material layer over opposite surfaces thereof, i.e., an aluminum brazing sheet according to the present embodiment, a tube connecting plate 8 made from a brazing sheet having a brazing material layer over opposite surfaces thereof, i.e., an aluminum brazing sheet according to the present embodiment, and an intermediate plate 9 interposed between the header forming plate 7 and the tube connecting plate 8 and made from a bare metal material, i.e., a bare aluminum material, the plates 7 to 9 being arranged in superposed layers and brazed to one another.

Formed as spaced apart in the upward or downward direction in the header forming plate 7 are a plurality of, i.e., two, outward bulging portions 11A, 11B extending upward or downward and equal in bulging height, length and width. An opening of each of the outward bulging portions 11A, 11B facing leftward is closed with the intermediate plate 9. The header forming plate 7 is made from an aluminum brazing sheet having a brazing material layer over opposite surfaces thereof by press work. A refrigerant inlet 12 is formed in the top of the upper bulging portion 11A of the plate 7, and an inlet member 13 made of a metal, i.e., bare aluminum material, and having a refrigerant inflow channel 14 communication with the inlet 12 is brazed to the outer surface of the outward bulging portion 11A utilizing the brazing material on the outer surface of the plate 7. A refrigerant outlet 15 is formed in the top of the lower bulging portion 11B, and an outlet member 16 made of a metal, i.e., bare aluminum material, and having a refrigerant outflow channel 17 in communication with the outlet 15 is brazed to the outer surface of the outward bulging portion 11B utilizing the brazing material on the outer surface of the plate 7.

The tube connecting plate 8 has a plurality of tube insertion holes 18 extending through the thickness thereof, elongated in the front-rear direction and arranged upward or downward at a spacing. The insertion holes 18 in the upper half of the plate 8 are provided within the upward or downward range of the upper bulging portion 11A of the header forming plate 7, and the insertion holes 18 in the lower half of the plate 8 are provided within the upward or downward range of the lower bulging portion 11B of the header forming plate. The front-to-rear length of each tube insertion hole 18 is slightly larger than the front-to-rear width of the outward bulging portion 11A or 11B, and the front and rear ends of the tube insertion hole 18 project outward beyond the respective front and rear side edges of the bulging portion 11A or 11B (see FIGS. 4 and 5). The tube connecting plate 8 is integrally provided at each of its front and rear side edges with a cover wall 19 projecting rightward to the outer surface of the header forming plate 7, covering the boundary between the plate 7 and the intermediate plate 9 over the entire length thereof and brazed to the front or rear side faces of the plates 7, 9. The projecting end of the cover wall 19 is integrally provided with engaging portions 21 arranged upward or downward at a spacing, engaging with the outer surface of the plate 7 and brazed to the plate 7. The tube connecting plate 8 is made from an aluminum brazing sheet having a brazing material layer over opposite surfaces thereof by press work.

The intermediate plate 9 has communication holes 22 extending through the thickness thereof and equal in number to the number of tube insertions holes 18 in the tube connecting plate 8 for causing the holes 18 to communicate with the outward bulging portion 11A or 11B of the plate 7 therethrough. The communication holes 22 are substantially larger than the insertion holes 18 (see FIG. 5). The communication holes 22 are positioned in corresponding relation with the respective tube insertion holes 18 of the tube connecting plate 8. The tube insertion holes 18 in the upper half of the plate 8 communicate with the interior of the upper bulging portion 11A through the communication holes 22 in the upper half of the intermediate plate 9, and the tube insertion holes 18 in the lower half of the plate 8 communicate with the interior of the lower bulging portion 11B through the communication holes 22 in the lower half of the intermediate plate 9. All the communication holes 22 communicating with the interior of the upper bulging portion 11A, as well as all the communication holes 22 communicating with the interior of the lower bulging portion 11B, are held in communication by communication portions 23 formed by cutting away the portion between each adjacent pair of holes 22 in the intermediate plate 9. The intermediate plate 9 is made from a bare aluminum material by press work.

Figure 2:
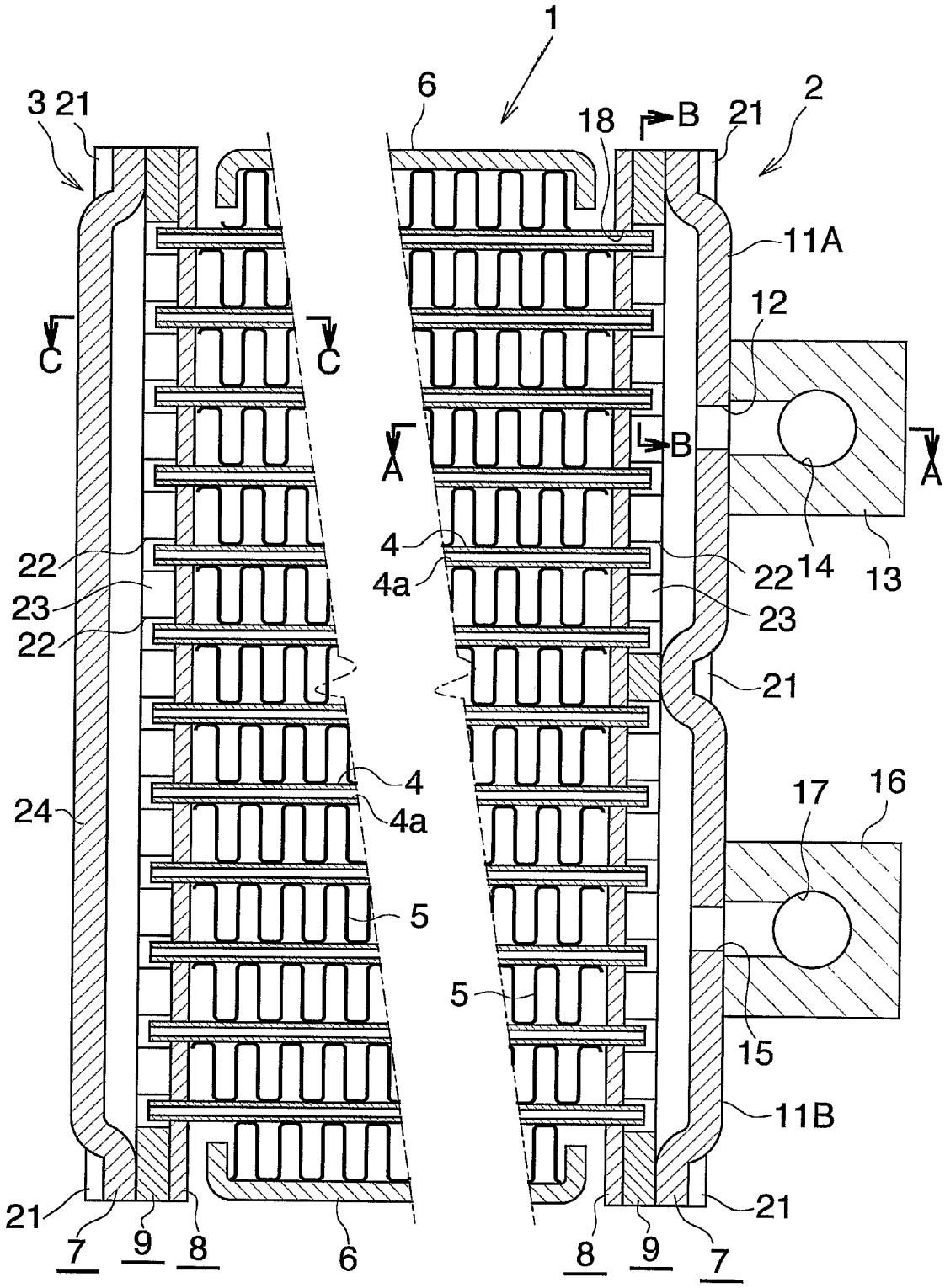
FIG. 2 is a fragmentary view in vertical section showing the gas cooler of FIG. 1 as it is seen from behind toward the front.
Figure 3:
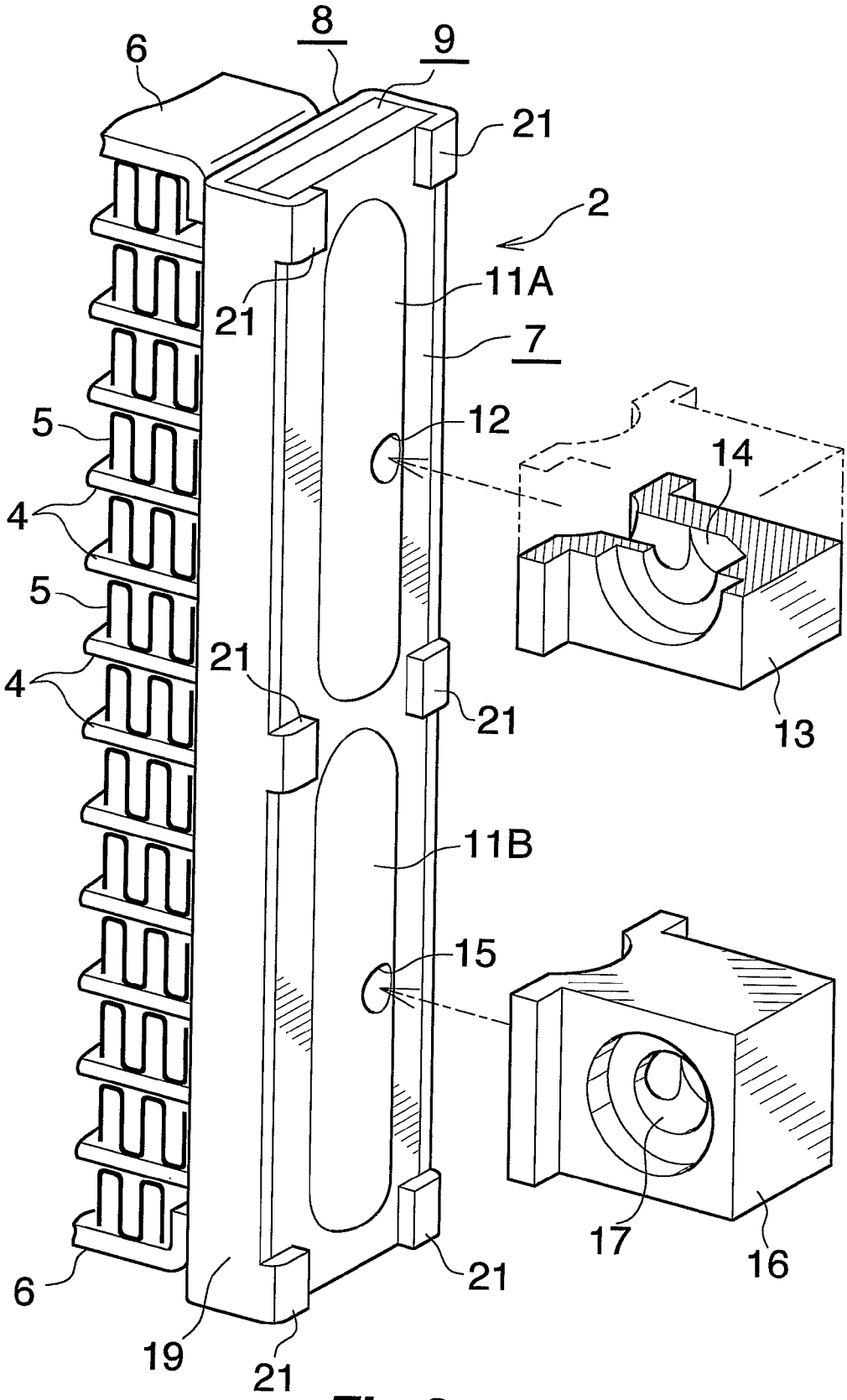
FIG. 3 is an exploded perspective view showing a first header tank of the gas cooler of FIG. 1.
Figure 4:
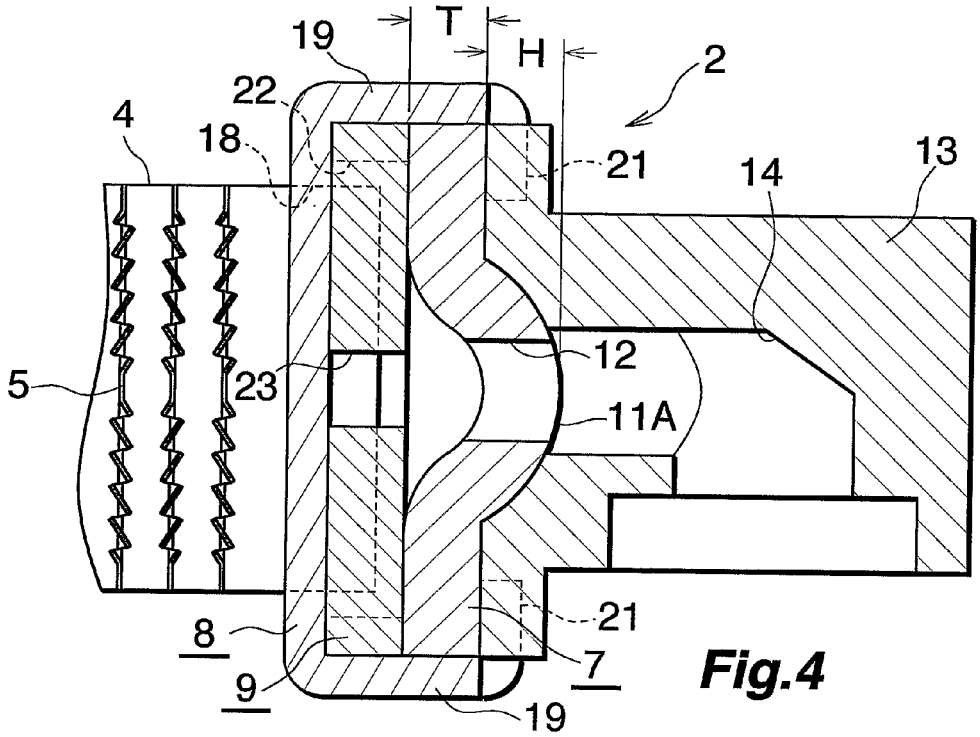
FIG. 4 is an enlarged view in section taken along the line A-A in FIG. 2.
Figure 5:
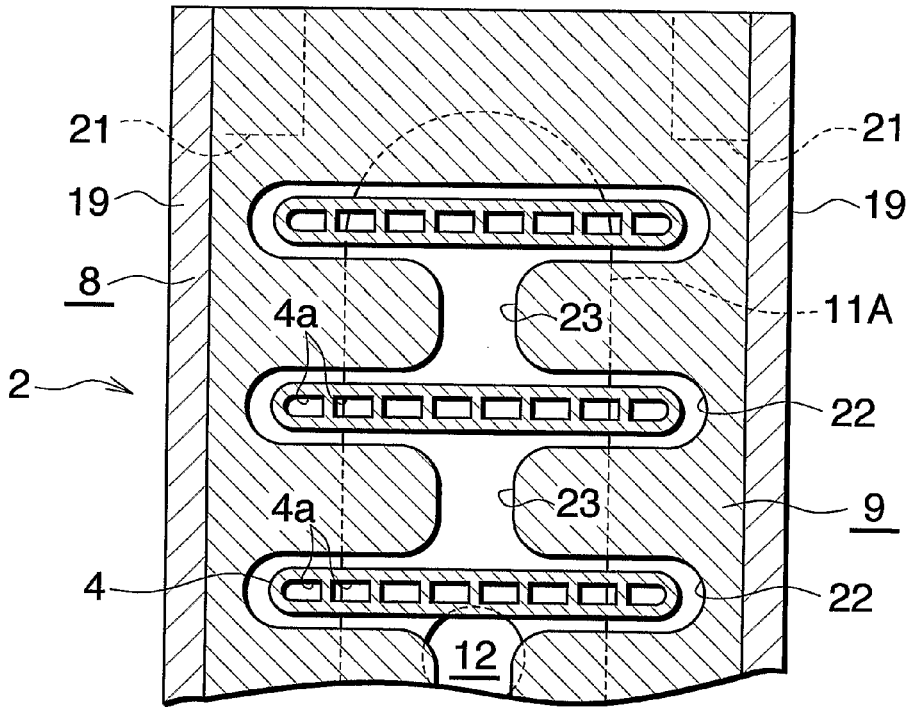
FIG. 5 is an enlarged view in section taken along the line B-B in FIG. 2.
Figure 6:
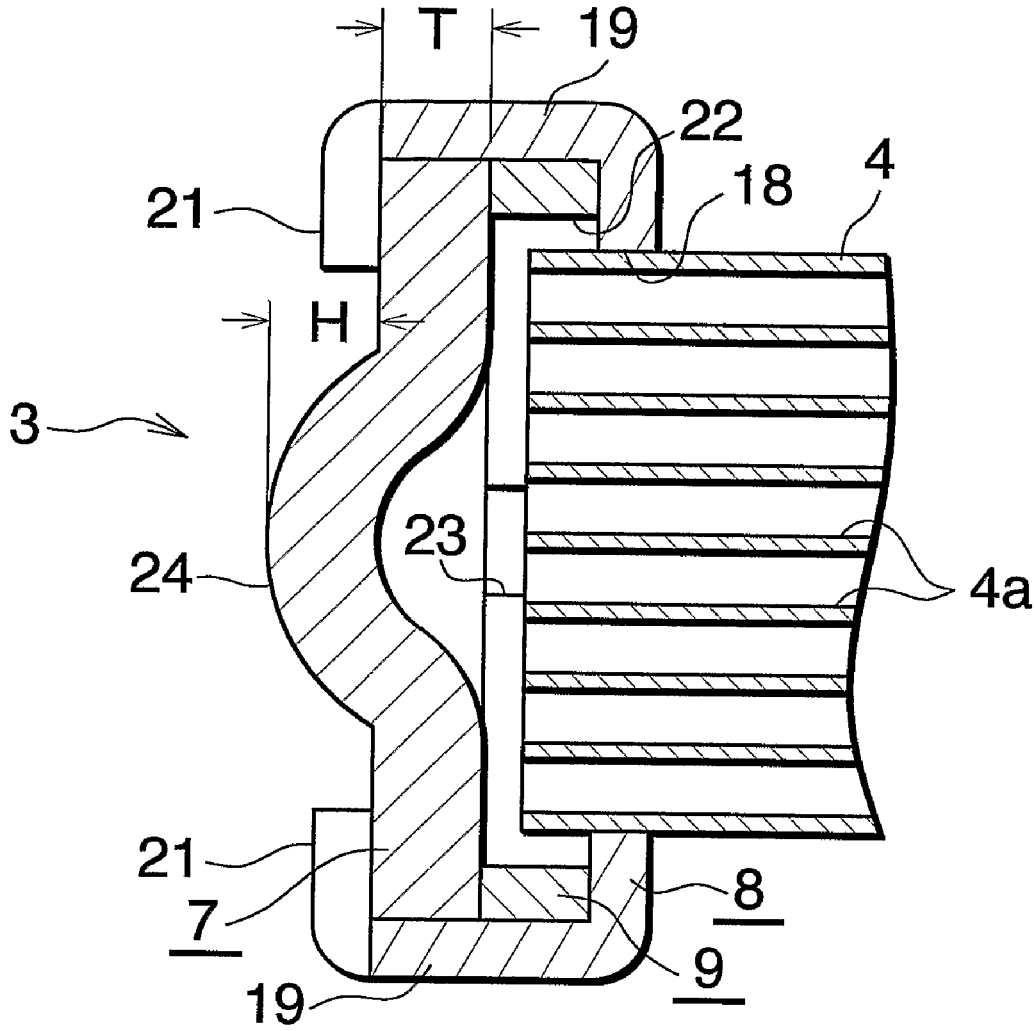
FIG. 6 is an enlarged view in section taken along the line C-C in FIG. 2.

The second header tank 3 has approximately the same construction as the first header tank 2, and through out the drawings concerned like parts are designated by like reference numerals (see FIGS. 2 and 6). The two header tanks 2, 3 are arranged with their tube connecting plates 8 opposed to each other. The second header tank 3 differs from the first header tank 2 in that the header forming plate 7 has one outward bulging portion 24 which is one smaller in number than the number of outward bulging portions 11A, 11B of the first header tank 2 and which extends from the upper end of the header forming plate 7 to the lower end thereof so as to face both the bulging portions 11A, 11B of the first header tank 2, that the outer bulging portion 24 has neither of the refrigerant inlet and outlet, that all tube insertion holes 18 of the tube connecting plate 8 communicate with the interior of the bulging portion 24 through all the communication holes 22 in the intermediate plate 9, and that all the communication holes 22 of the intermediate plate 9 are held in communication by communication portions 23 formed by cutting away the portion between each adjacent pair of communication holes 22. The outward bulging portion 24 is equal to the outward bulging portions 11A, 11B of the first header tank 2 in bulging height and in width.

Now, suppose the header forming plate 7 has a wall thickness T, and the outward bulging portions 11A, 11B, 24 are H in bulging height. It is then desired that H/T be in the range of 0.5 to 1.5 (see FIGS. 4 and 6). If H/T is less than 0.5, the bulging portions 11A, 11B are small in the cross sectional area of refrigerant channel therein to result in an increased internal pressure loss and entail the likelihood of adversely affecting the radiation efficiency of the gas cooler 1. If the ratio is in excess of 1.5, the outer bulging portions 11A, 11B will have a reduced wall thickness at their peripheral wall portions due to a wall thickness reduction caused by press work, entailing the likelihood that the gas cooler 1 will become insufficient in pressure resistant strength.

Figure 7:
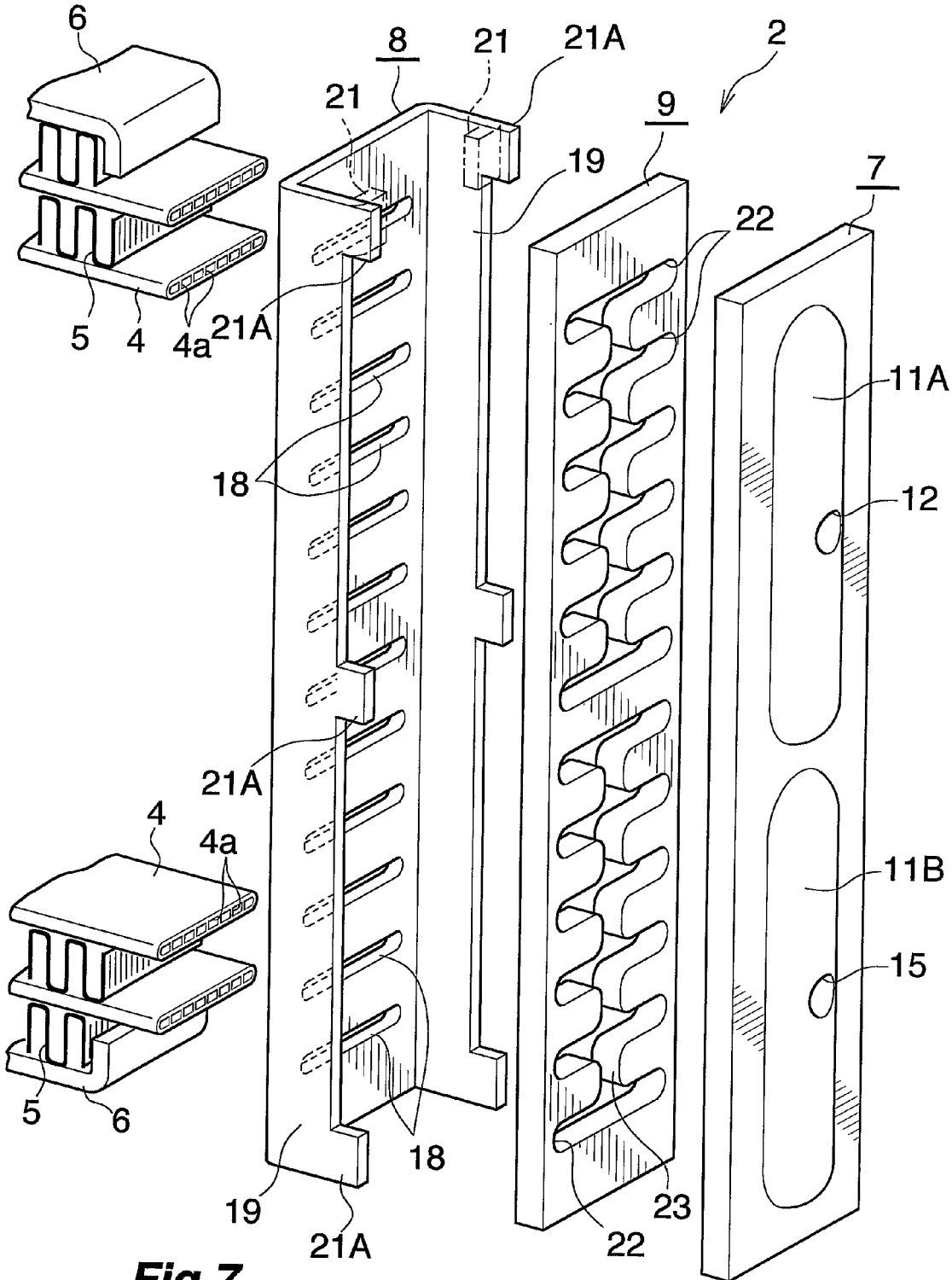
FIG. 7 is an exploded perspective view of the first header tank of the gas cooler of FIG. 1.
Figure 8:
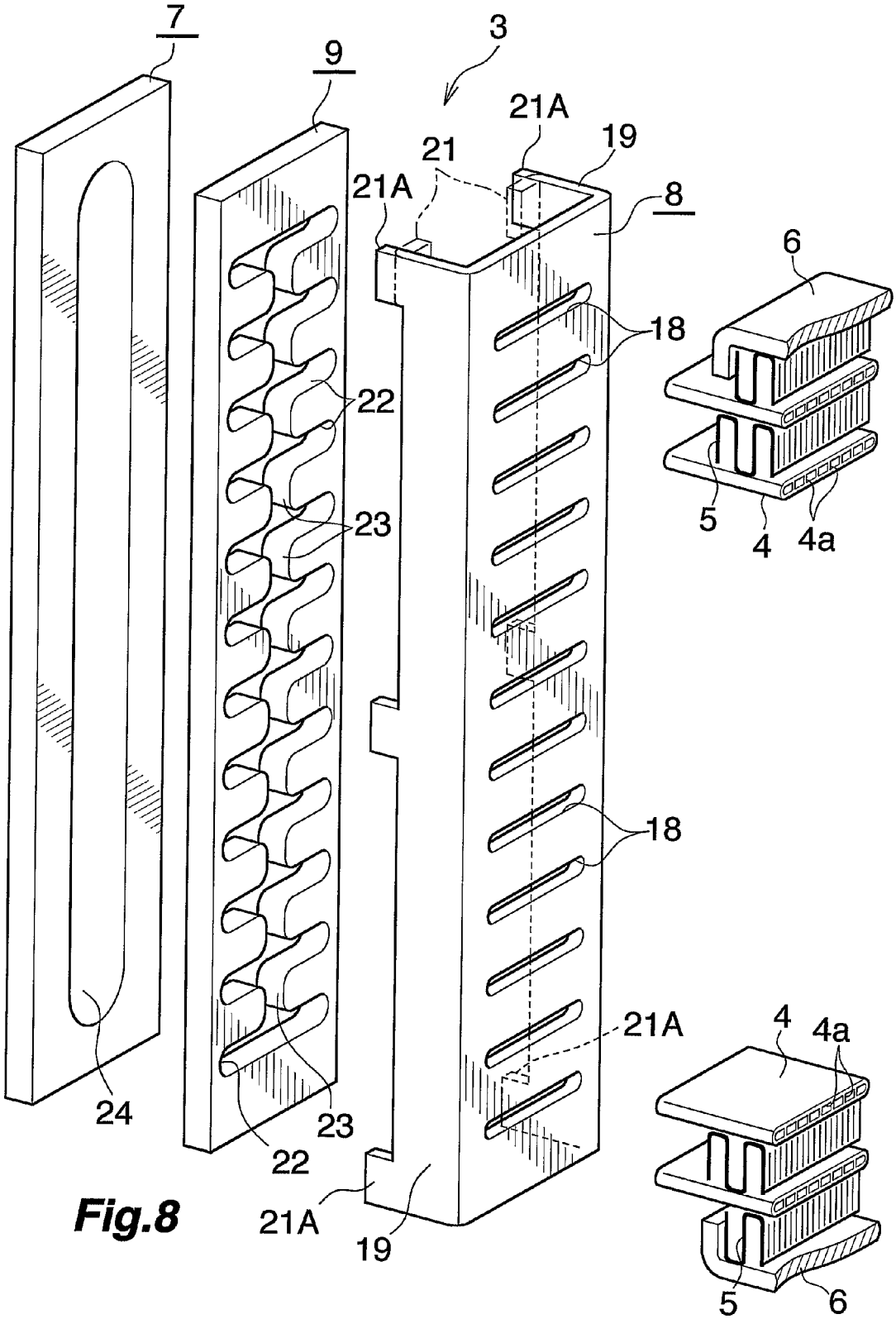
FIG. 8 is an exploded perspective view of a second header tank of the gas cooler of FIG. 1.

The header tanks 2, 3 are made in the manner shown in FIGS. 7 and 8.

First, an aluminum brazing sheet having a brazing material layer over opposite surfaces thereof is subjected to press work to make header forming brazing plates 7 having outward bulging portions 11A, 11B or an outward bulging portion 24. Tube connecting plates 8 each having tube insertion holes 18, cover walls 19 and engaging portion forming lugs 21A extending straight from each of the cover walls 19 are made from an aluminum brazing sheet having a brazing material layer over opposite surfaces thereof by press work. Intermediate plates 9 having communication holes 22 and communication portions 23 are further made from a bare aluminum material by press work.

The three plates 7, 8, 9 for each of the header tanks 2, 3 are then fitted together in superposed layers, the lugs 21A are thereafter bent to form engaging portions 21, and the engaging portions 21 are caused to engage with the header forming plate 7. In this way, two tacked assemblies are obtained. Utilizing the brazing material layers of the plates 7, 8, the three plates 7, 8, 9 of each assembly are then brazed to one another, the cover walls 19 are brazed to the front and rear side faces of the intermediate plate 9 and header forming plate 7, and the engaging portions 21 are brazed to the plate 7. Thus, the two header tanks 2, 3 are made.

Each of the heat exchange tubes 4 is made from a metal extrudate, i.e., an aluminum extrudate in the present embodiment, is in the form of a flat tube having an increased width in the front-rear direction and has inside thereof a plurality of refrigerant channels 4*a* extending longitudinally thereof and arranged in parallel. The heat exchange tubes 4 are brazed to the tube connecting plates 8 of the two header tanks 2, 3 using the brazing material layers of the plates 8, with their opposite ends placed into the respective tube insertion holes 18 of the tanks 2, 3. Each end of the tube 4 is placed into the communication hole 22 of the intermediate plate 9 to an intermediate portion of the thickness thereof (see FIGS. 4 and 6). The heat exchange tubes 4 in the upper half of the cooler to be fabricated have their right ends connected to the first header tank 2 so as to communicate with the interior of the upper outward bulging portion 11A, and have their left ends connected to the second header tank 3 so as to communicate with the interior of the outward bulging portion 24. Further the heat exchange tubes 4 in the lower half have their right ends connected to the first header tank 2 so as to communicate with the interior of the lower outward bulging portion 11B, and have their left ends connected to the second header tank 3 so as to communicate with the interior of the outward bulging portion 24.

Each of the corrugated fins 5 is made in a wavy form from a brazing sheet having a brazing material layer over opposite surfaces thereof, i.e., an aluminum brazing sheet according to the present embodiment.

The gas cooler 1 is fabricated by preparing the above-mentioned two tacked assemblies for making two header tanks 2, 3, heat exchanges tubes 4 and corrugated fins 5; arranging the two tacked assemblies as spaced apart with their tube connecting plates 8 opposed to each other; arranging the heat exchange tubes 4 and the corrugated fins 5 alternately; inserting opposite ends of the heat exchange tubes 4 into the respective tube insertion holes 18 of the tube connecting plates 8 of the two tacked assemblies; arranging side plates 6 externally of the respective corrugated fins 5 at opposite ends of the resulting assembly; arranging an inlet member 13 and an outlet member 16 at the respective bulging portions 11A, 11B of the header forming plate 7 for making the first header tank 2; and brazing the three plates 7, 8, 9 of each tacked assembly to make header tanks 2, 3, and brazing the heat exchange tubes 4 to the header tanks 2, 3, each fin 5 to the heat exchange tubes 4 adjacent thereto, each side plate 6 to the fin 5 adjacent thereto, and the inlet member 13 and the outlet member 16 to the respective bulging portions 11A, 11B simultaneously with the brazing of each tacked assembly.

The gas cooler 1 provides a supercritical refrigeration cycle along with a compressor, evaporator, pressure reducing device and an intermediate heat exchanger for subjecting the refrigerant flowing out from the gas cooler and the refrigerant flowing out from the evaporator to heat exchange, and the refrigeration cycle is installed in vehicles, for example, in motor vehicles, as a motor vehicle air conditioner.

Figure 9:
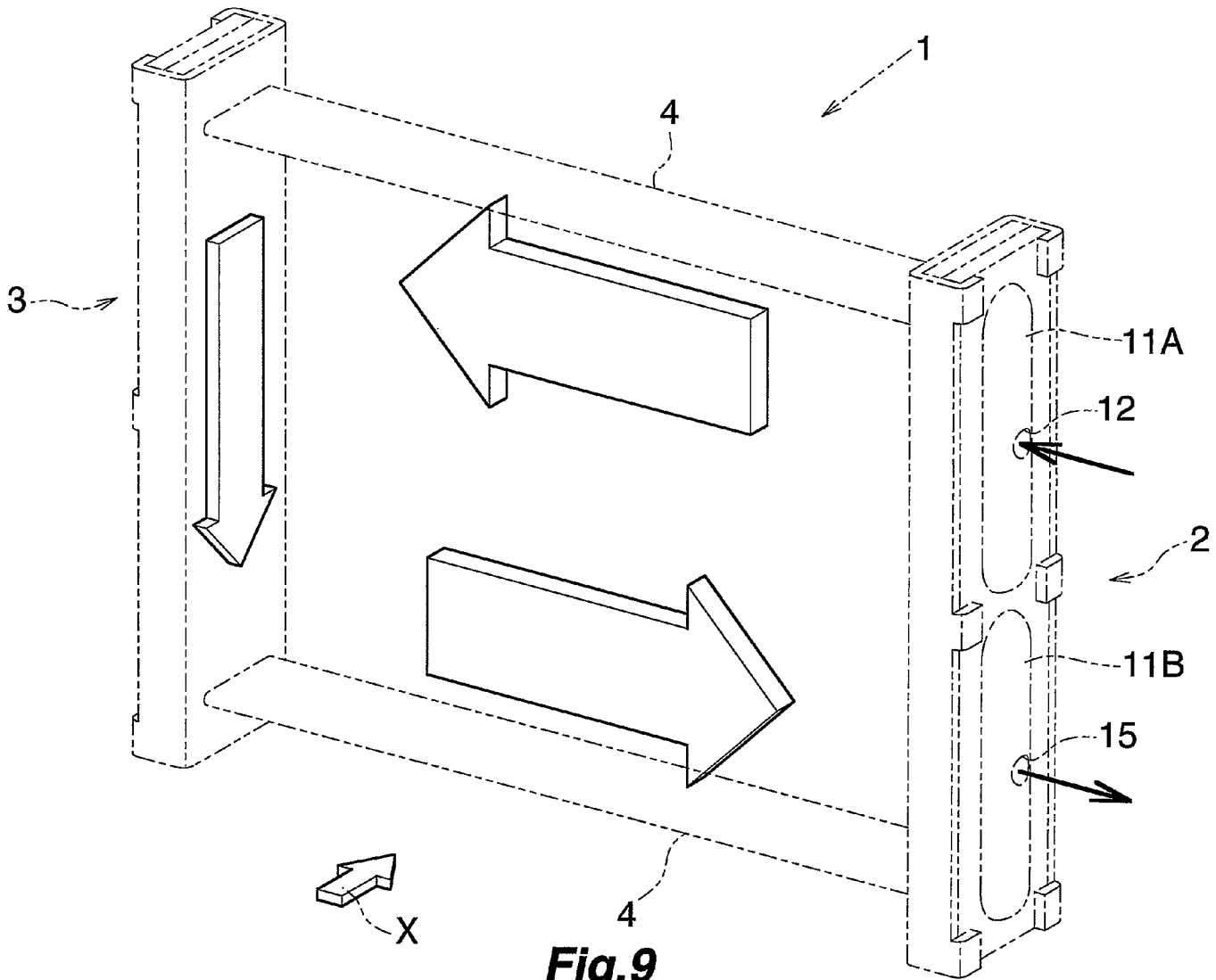
FIG. 9 is a diagram showing the flow of a refrigerant through the gas cooler of FIG. 2.

With the gas cooler 1 described above, $CO_2$ passing through a compressor flows through the refrigerant inflow channel 14 of the inlet member 13, then flows through the inlet 12 into the upper bulging portion 11A of the first header tank 2, and thereafter dividedly flows into the refrigerant channels 4*a* of all the heat exchange tubes 4 in communication with the interior of the upper bulging portion 11A as shown in FIG. 9. The $CO_2$ in the channels 4*a* flows leftward through the channels 4*a* and enters the bulging portion 24 of the second header tank 3. The $CO_2$ in the portion 24 flows down through the portion 24 and the communication portions 23 of the intermediate plate 9, then dividedly flows into the channels 4*a* of all the heat exchange tubes 4 in communication with the lower bulging portion 11B, changes its course, flows rightward through the channels 4*a* and enters the lower bulging portion 11B of the first header tank 2. The $CO_2$ thereafter flows out of the cooler via the outlet 15 and the outflow channel 17 of the outlet member 16. While flowing through the channels 4*a* of the heat exchange tubes 4, the $CO_2$ is subjected to heat exchange with the air flowing through the air passing clearances in the direction of arrows X shown in FIGS. 1 and 9 and is thereby cooled.

Embodiment 2

This embodiment is shown in FIGS. 10 to 20 and comprises a heat exchanger of the invention adapted for use as an evaporator in supercritical refrigeration cycles.

Figure 10:
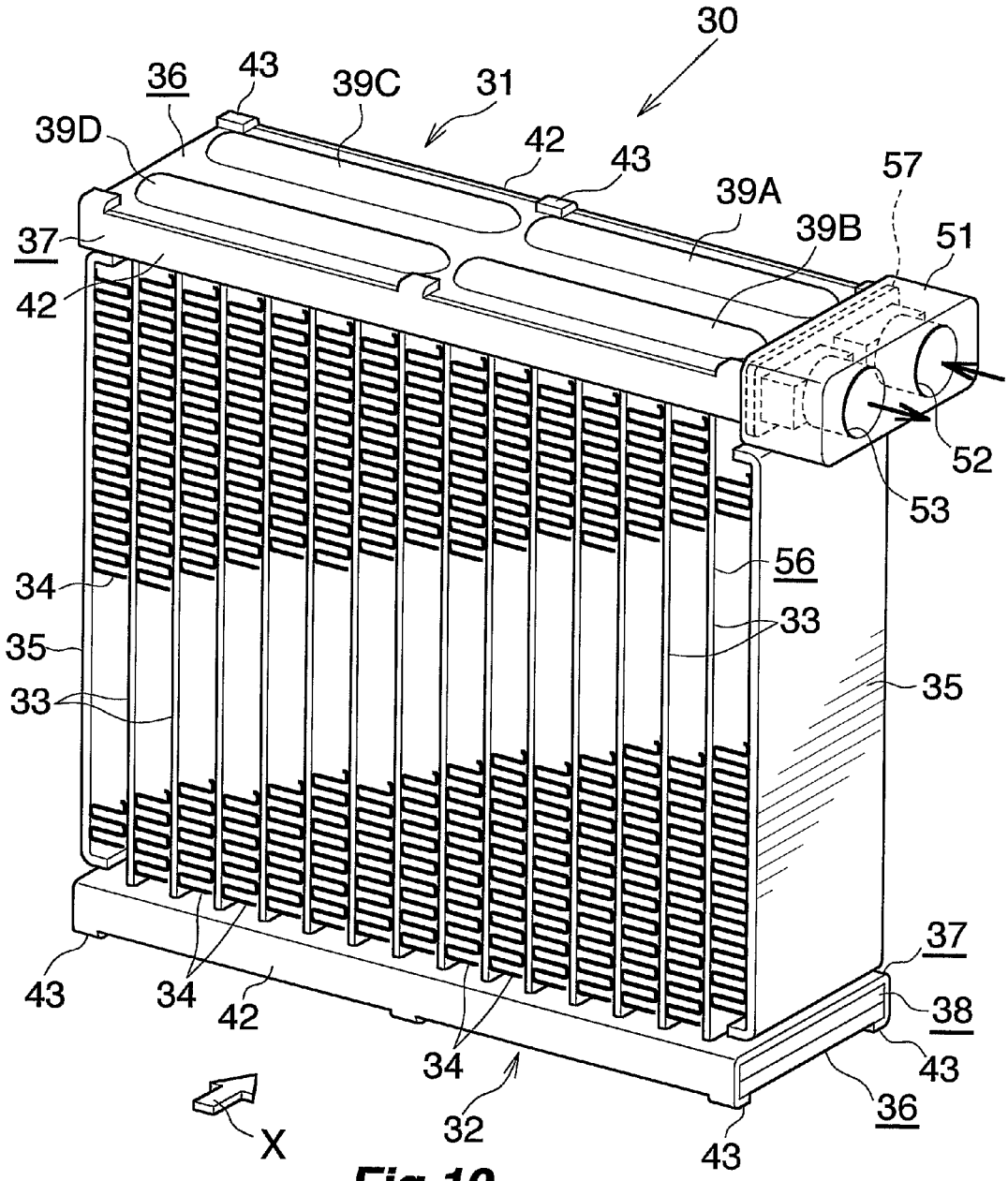
FIG. 10 is a perspective view showing the overall construction of a heat exchanger of the invention for use as an evaporator.
Figure 11:
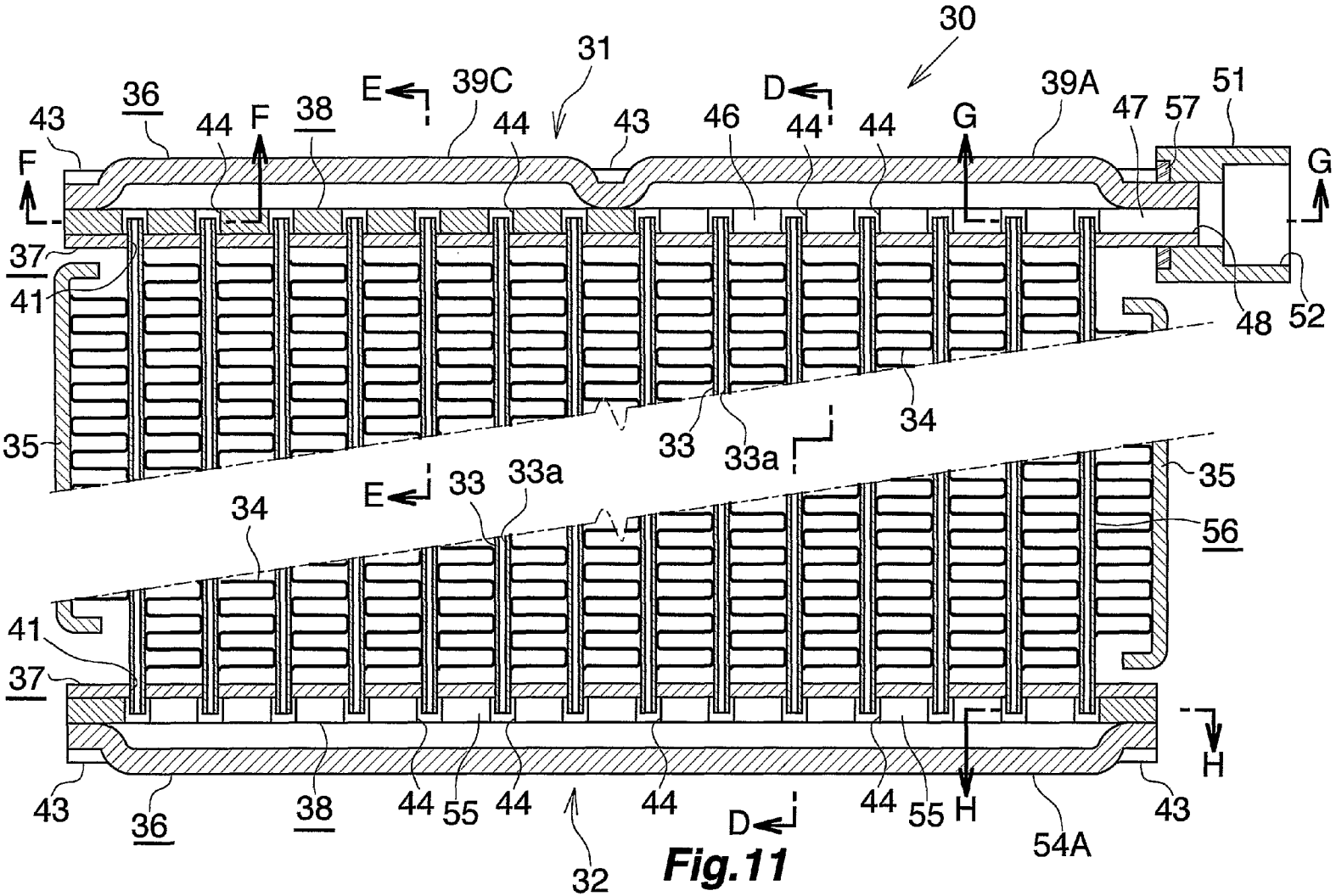
FIG. 11 is a fragmentary view in vertical section showing the evaporator of FIG. 10 as it is seen from behind toward the front.
Figure 12:
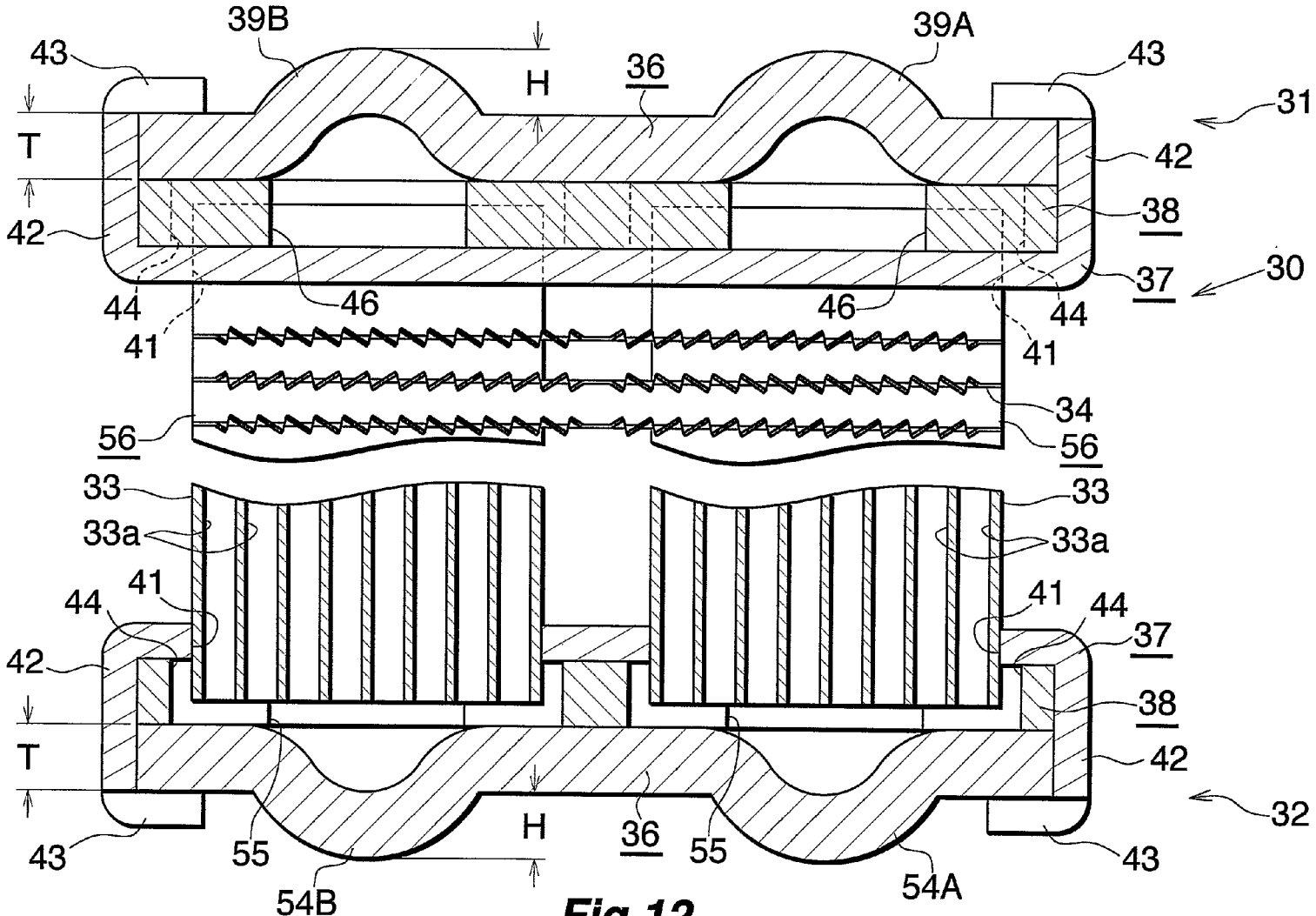
FIG. 12 is an enlarged view in section taken along the line D-D in FIG. 11.
Figure 13:
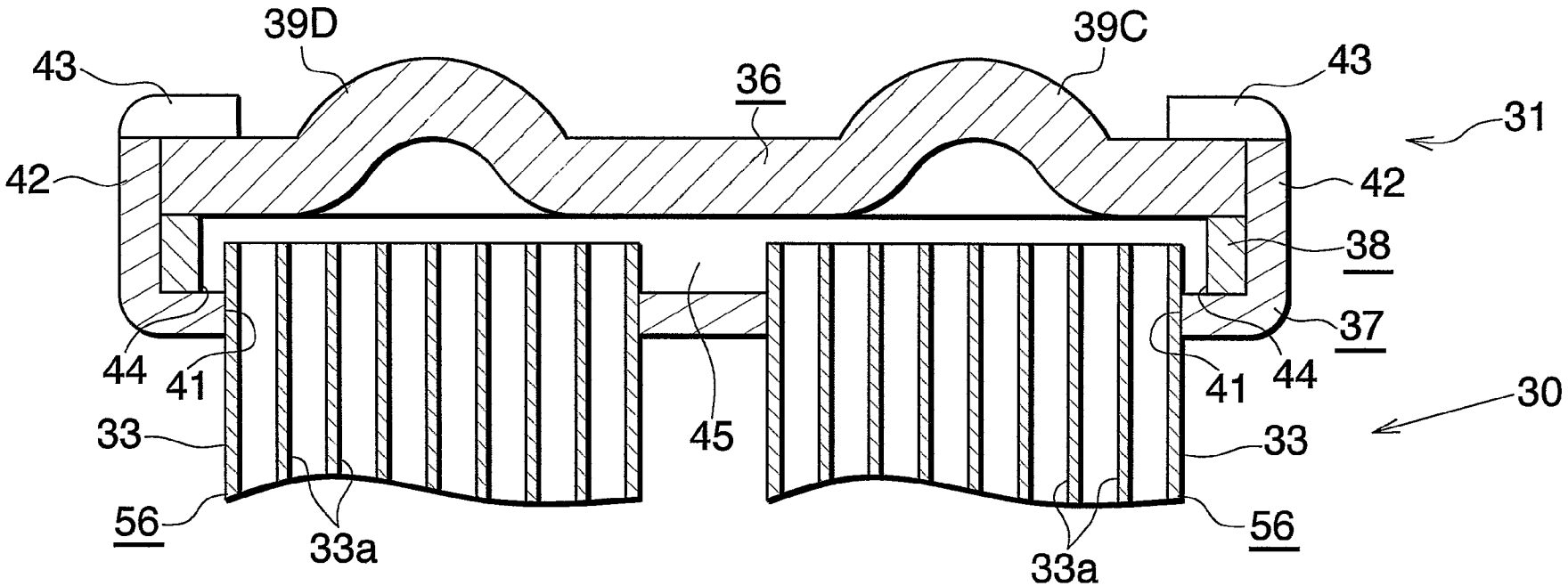
FIG. 13 is an enlarged view in section taken along the line E-E in FIG. 11.
Figure 14:
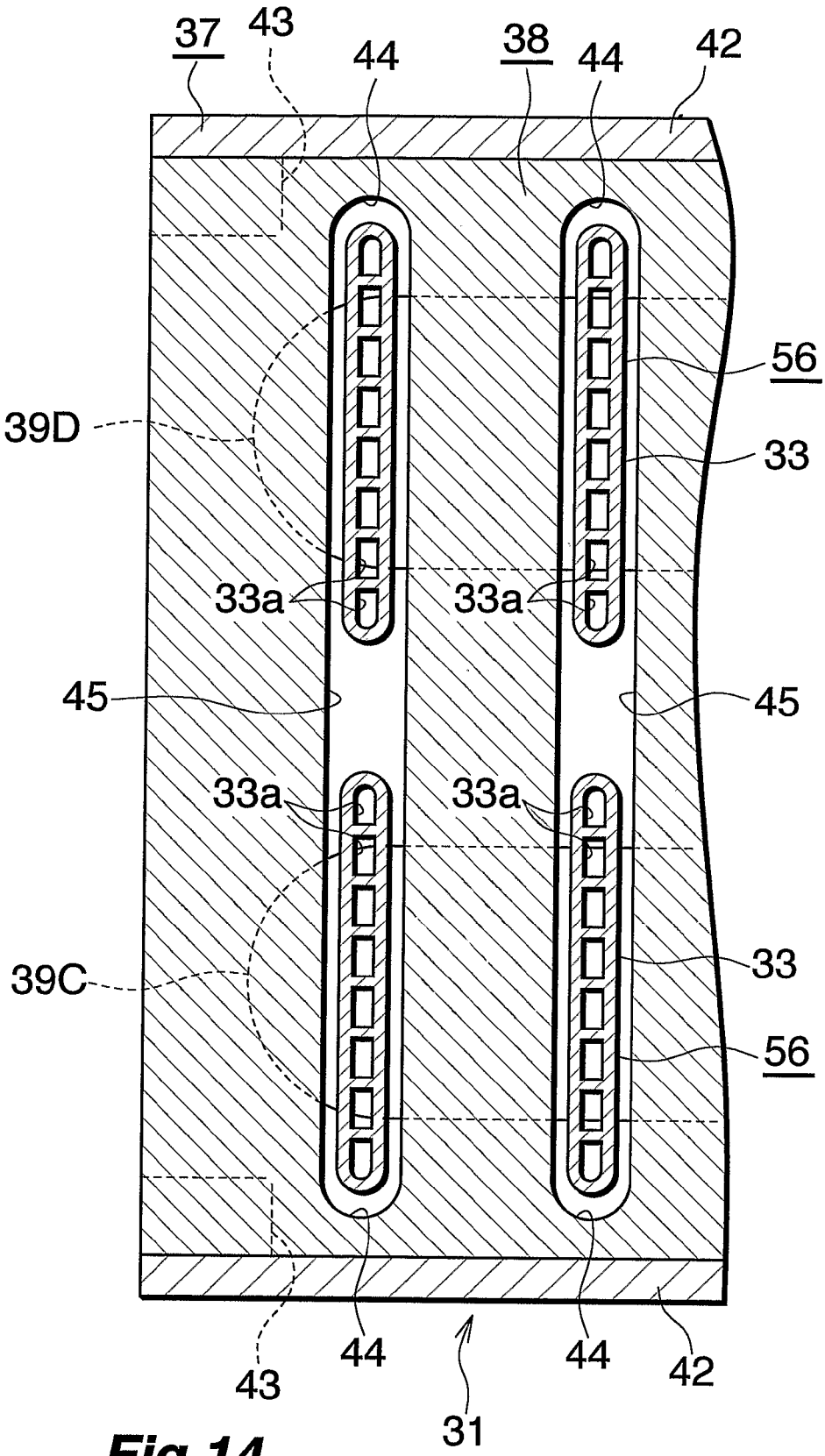
FIG. 14 is an enlarged view in section taken along the line F-F in FIG. 11.

With reference to FIGS. 10 to 12, the evaporator 30 for use in supercritical refrigeration cycles wherein a supercritical refrigerant, such as $CO_2$, is used comprises two header tanks 31, 32 extending in the left-right direction and arranged as spaced part in the upward or downward direction, a plurality of flat heat exchange tubes 33 arranged in parallel in the left-right direction at a spacing between the two header tanks 31, 32, corrugated fins 34 arranged in respective air passing clearances between respective adjacent pairs of heat exchange tubes 33 and outside the heat exchange tubes 33 at the left and right ends of the evaporator and each brazed to the adjacent pair of heat exchange tubes 33 or to the end tube 33, and side plates 35 of aluminum arranged externally of and brazed to the respective fins 34 at the left and right ends. In the case of this embodiment, the upper header tank 31 will be referred to as the "first header tank," and the lower header tank 32 as the "second header tank."

The first header tank 31 comprises a header forming plate 36 made from a brazing sheet having a brazing material layer over opposite surfaces thereof, i.e., an aluminum brazing sheet according to the present embodiment, a tube connecting plate 37 made from a brazing sheet having a brazing material layer over opposite surfaces thereof, i.e., an aluminum brazing sheet according to the present embodiment, and an intermediate plate 38 interposed between the header forming plate 36 and the tube connecting plate 37 and made from a bare metal material, i.e., a bare aluminum material, the plates 36 to 38 being arranged in superposed layers and brazed to one another.

The header forming plate 36 of the first header tank 31 has a right portion and a left portion which are provided with two outward bulging portions 39A, 39B and two outward bulging portions 39C, 39D, respectively. The two bulging portions in each of the right and left plate portions extend in the left-right direction and are spaced apart in the front-rear direction. In the present embodiment, the bulging portion 39A in the right front plate portion will be referred to as the "first outward bulging portion," the bulging portion 39B in the right rear plate portion as the "second outward bulging portion," the bulging portion 39C in the left front plate portion as the "third outward bulging portion," and the bulging portion 39D in the left rear plate portion as the "fourth outward bulging portion." The bulging portions 39A to 39D have respective openings facing down and closed with the intermediate plate 38. The bulging portions 39A to 39D are equal in bulging height, length and width. The header forming plate 36 is made from an aluminum brazing sheet having a brazing material layer over opposite surfaces thereof by press work.

The tube connecting plate 37 is provided in each of front and rear opposite side portions thereof with a plurality of tube insertion holes 41 elongated in the front-rear direction, arranged in the left-right direction at a spacing and extending through the thickness of the plate 37. The tube insertion holes 41 in the front right half portion are formed within the left-to-right range of the first outward bulging portion 39A of the header forming plate 36, the tube insertion holes 41 in the rear right half portion are formed within the left-to-right range of the second outward bulging portion 39B, the tube insertion holes 41 in the front left half portion are formed within the left-to-right, range of the third outward bulging portion 39C, and the tube insertion holes 41 in the rear left half portion are formed within the left-to-right range of the fourth outward bulging portion 39D. The tube insertion holes 41 have a length slightly larger than the front-to-rear width of the bulging portions 39A to 39D, and have front and rear end portions projecting outward beyond the respective front and rear side edges of the corresponding bulging portions 39A to 39D. The tube connecting plate 37 is integrally provided at each of its front and rear side edges with a cover wall 42 projecting upward to the outer surface of the header forming plate 36, covering the boundary between the plate 36 and the intermediate plate 38 over the entire length thereof and brazed to the front or rear side faces of the plates 36, 38. The projecting end of the cover wall 42 is integrally provided with engaging portions 43 arranged in the left-right direction at a spacing, engaging with the outer surface of the plate 36 and brazed to the plate 36. The tube connecting plate 37 is made from an aluminum brazing sheet having a brazing material layer over opposite surfaces thereof by press work.

The intermediate plate 38 has communication holes 44 extending through the thickness thereof and equal in number to the number of tube insertions holes 41 in the tube connecting plate 37 for causing the holes 41 to communicate with one of the outward bulging portions 39A to 39D of the header forming plate 36 therethrough in corresponding relation. The communication holes 44 are substantially larger than the insertion holes 41. The communication holes 44 are positioned in corresponding relation with the respective tube insertion holes 41 of the tube connecting plate 37. The tube insertion holes 41 in the front right half portion of the tube connecting plate 37 are held in communication with the interior of the first outward bulging portion 39A through the communication holes 44 in the front right half portion of the intermediate plate 38. The tube insertion holes 41 in the rear right half portion of the plate 37 are held in communication with the interior of the second outward bulging portion 39B through the communication holes 44 in the rear right half portion of the intermediate plate 38. The tube insertion holes 41 in the front left half portion of the plate 37 are held in communication with the interior of the third outward bulging portion 39C through the communication holes 44 in the front left half portion of the intermediate plate 38. The tube insertion holes 41 in the rear left half portion of the plate 37 are held in communication with the interior of the fourth outward bulging portion 39D through the communication holes 44 in the rear left half portion of the intermediate plate 38. The communication holes 44 in communication with the third bulging portion 39C are caused to communicate with the respective communication holes 44 communicating with the fourth bulging portion 39D by first communication portions 45 formed by cutting away the portions between respective front-to-rear adjacent pairs of communication holes 44 in the intermediate plate 38, whereby the interior of the third bulging portion 39C and the interior of the fourth bulging portion 39D are caused to communicate with each other (see FIGS. 13 and 14). All the communication holes 44 communicating with the interior of the first bulging portion 39A, as well as all the communication holes 44 communicating with the interior of the second bulging portion 39B, are held in communication through second communication portions 46 formed by removing the portions between respective left-to-right adjacent pairs of communication holes 44 in the intermediate plate 38 (see FIG. 15). The intermediate plate 38 is made from a bare aluminum material by press work.

Figure 15:
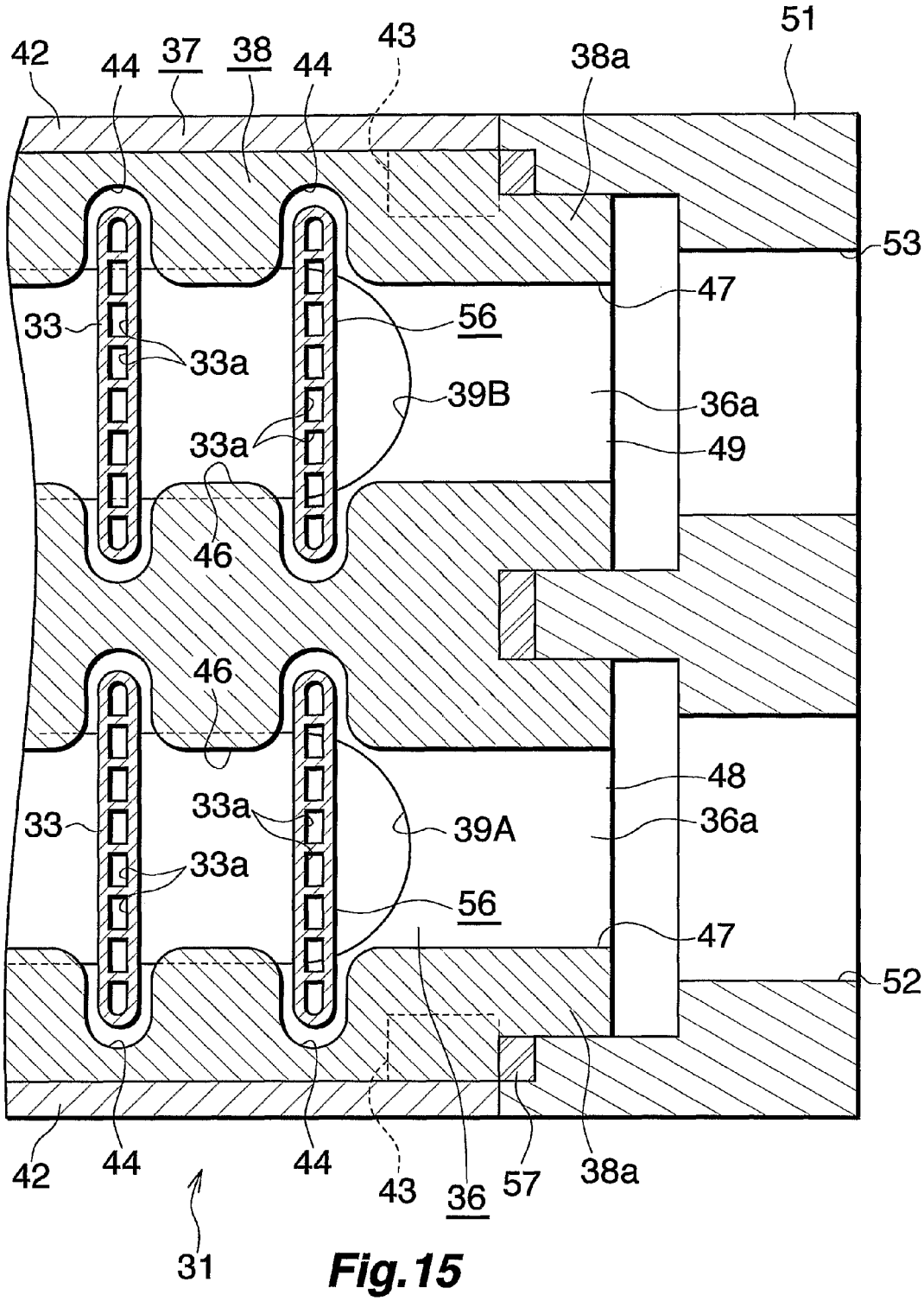
FIG. 15 is an enlarged view in section taken along the line G-G in FIG. 11.
Figure 16:
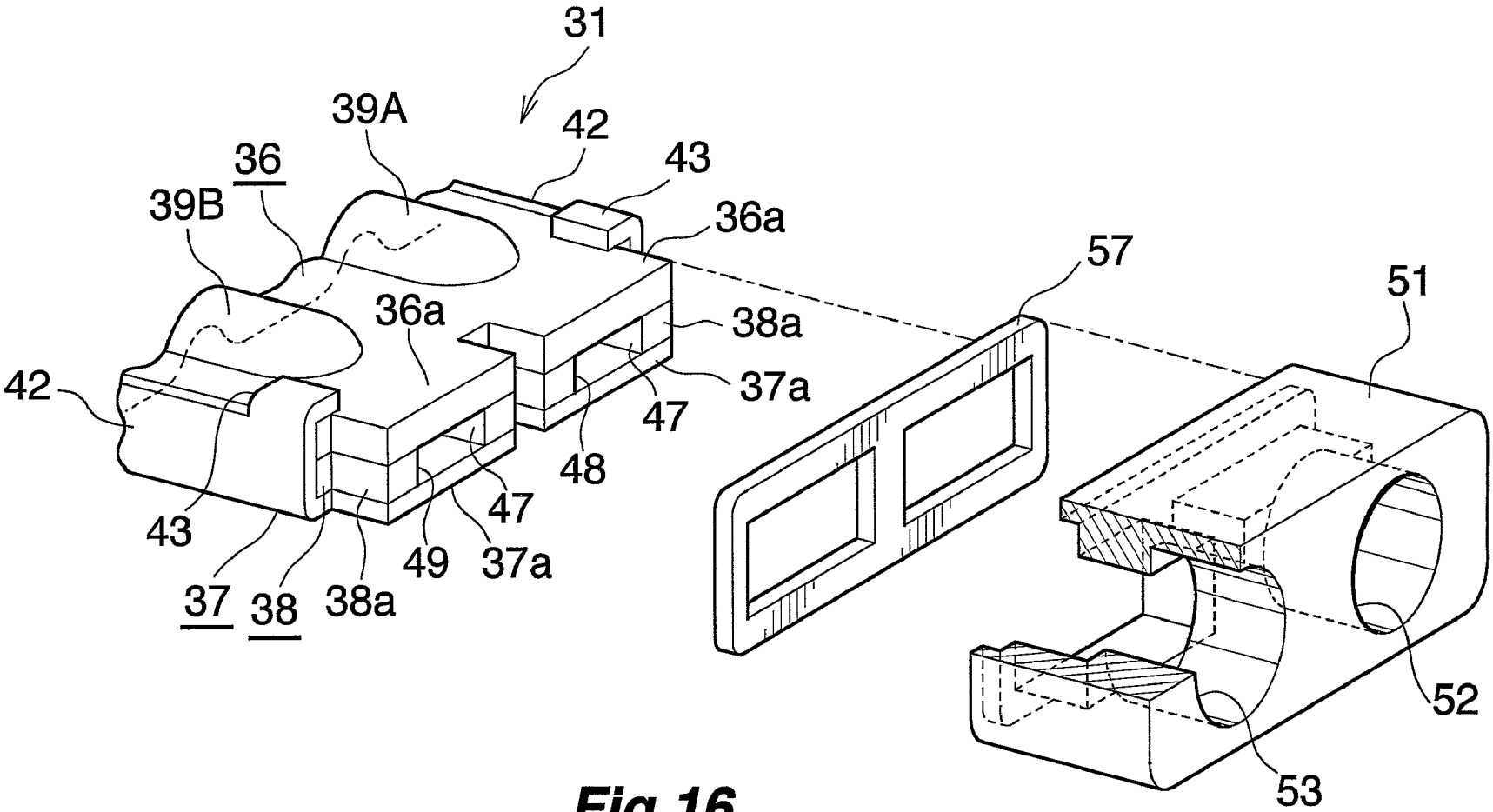
FIG. 16 is an exploded perspective view showing a right end portion of a first header tank of the evaporator of FIG. 10.

With reference to FIGS. 15 and 16, each of the three plates 36, 37, 38 is provided at the right end thereof with two rightward projections 36*a* (37*a*, 38*a*) spaced apart in the front-rear direction. The intermediate plate 38 has a cutout 47 extending from the outer end of each of the two outward projections 38*a* to the communication hole 44 at the right end. These cutouts 47 provide in the first header tank 31 a refrigerant inlet 48 communicating with the interior of the first outward bulging portion 39A and a refrigerant outlet 49 communicating with the interior of the second outward bulging portion 39B. A refrigerant inlet-outlet member 51 having a refrigerant inflow channel 52 communicating with the inlet 48 and a refrigerant outflow channel 53 communicating with the outlet 49 is brazed to the first header tank 31 with a brazing sheet having a brazing material layer over opposite surfaces thereof, i.e., an aluminum brazing sheet 57, so as to be positioned alongside the pairs of rightward projections 36*a*, 37*a*, 38*a* of the three plates 36, 37, 38. The inlet-outlet member 51 is made from a bare metal material, i.e., a bare aluminum material.

Figure 17:
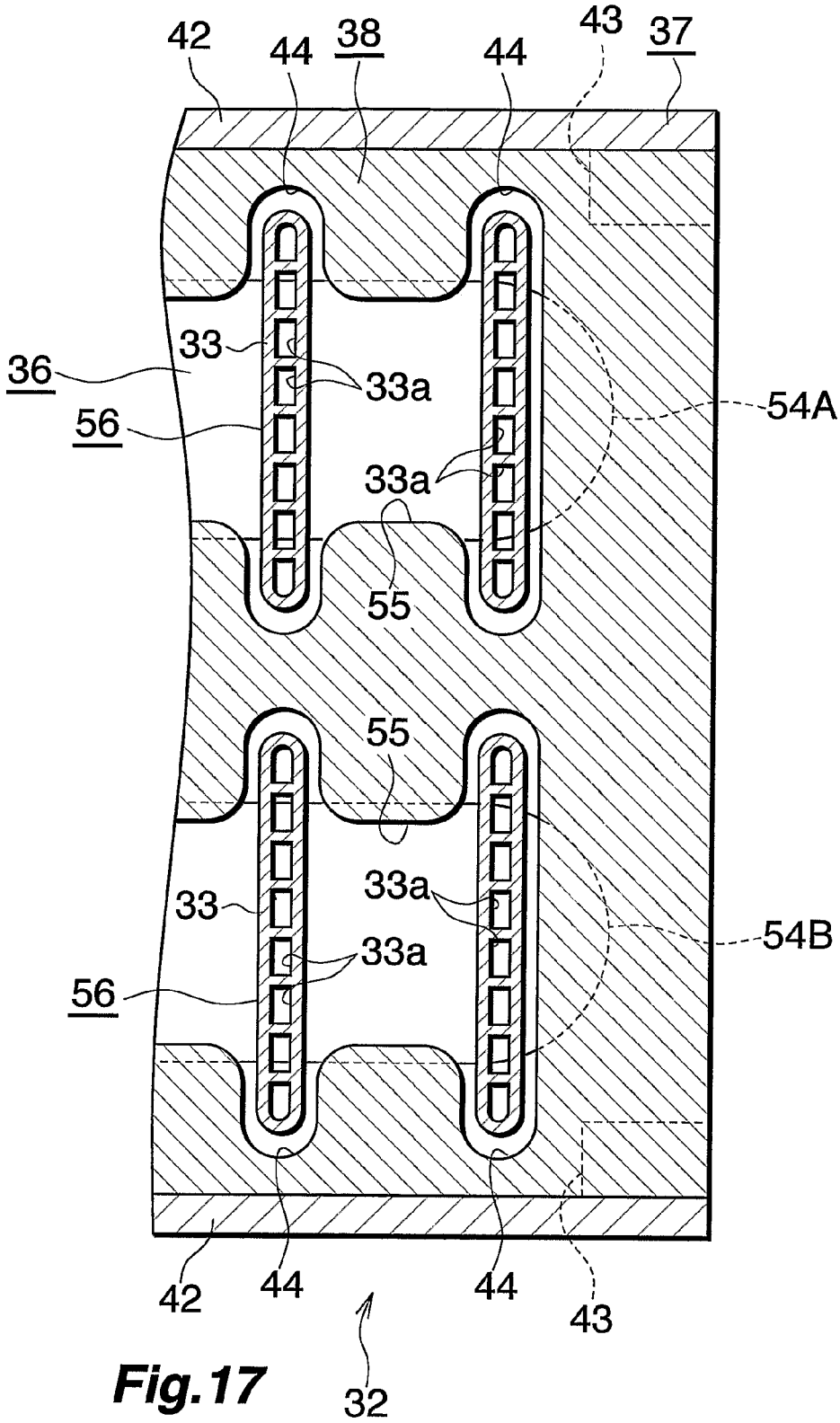
FIG. 17 is an enlarged view in section taken along the line H-H in FIG. 11.

The second header tank 32 has nearly the same construction as the first header tank 31, and like parts will be designated by like reference numerals throughout the drawings concerned (see FIGS. 12 and 17). The header forming tanks 31, 32 are arranged with their tube connecting plates 37 facing toward each other. The second header tank 32 differs from the first header tank 31 in that the header forming plate 36 has two outward bulging portions 54A, 54B extending from a right end portion thereof to a left end portion thereof and spaced apart in the front-rear direction so as to be opposed to both the first and third bulging portions 39A, 39C and both the second and fourth bulging portions 39B, 39D, respectively, that all the communication holes 44 communicating with each of the bulging portions 54A, 54B are held in communication through communication portions 55 formed by removing the portions between respective left-to-right adjacent pairs of communication holes 44 in the intermediate plate 38, that the two bulging portions 54A, 54B are not in communication and that the right ends of the three plates 36, 37, 38 are provided with no rightward projections. The bulging portions 54A, 54B are equal to the bulging portions 39A to 39D of the first header tank 31 with respect to each of the bulging height and width.

Now, suppose the header forming plate 36 has a wall thickness T, and the outward bulging portions 39A to 39D are H in bulging height. It is then desired that H/T be in the range of 1.0 to 2.0 (see FIG. 12). If H/T is less than 1.0, the bulging portions 39A to 39D are small in the cross sectional area of the refrigerant channel therein to result in an increased internal pressure loss and entail the likelihood of adversely affecting the radiation efficiency of the evaporator 30. If the ratio is in excess of 2.0, the outer bulging portions 39A to 39D will have a reduced wall thickness at their peripheral wall portions due to a wall thickness reduction caused by press work, entailing the likelihood that the evaporator 30 will become insufficient in pressure resistant strength.

Figure 18:
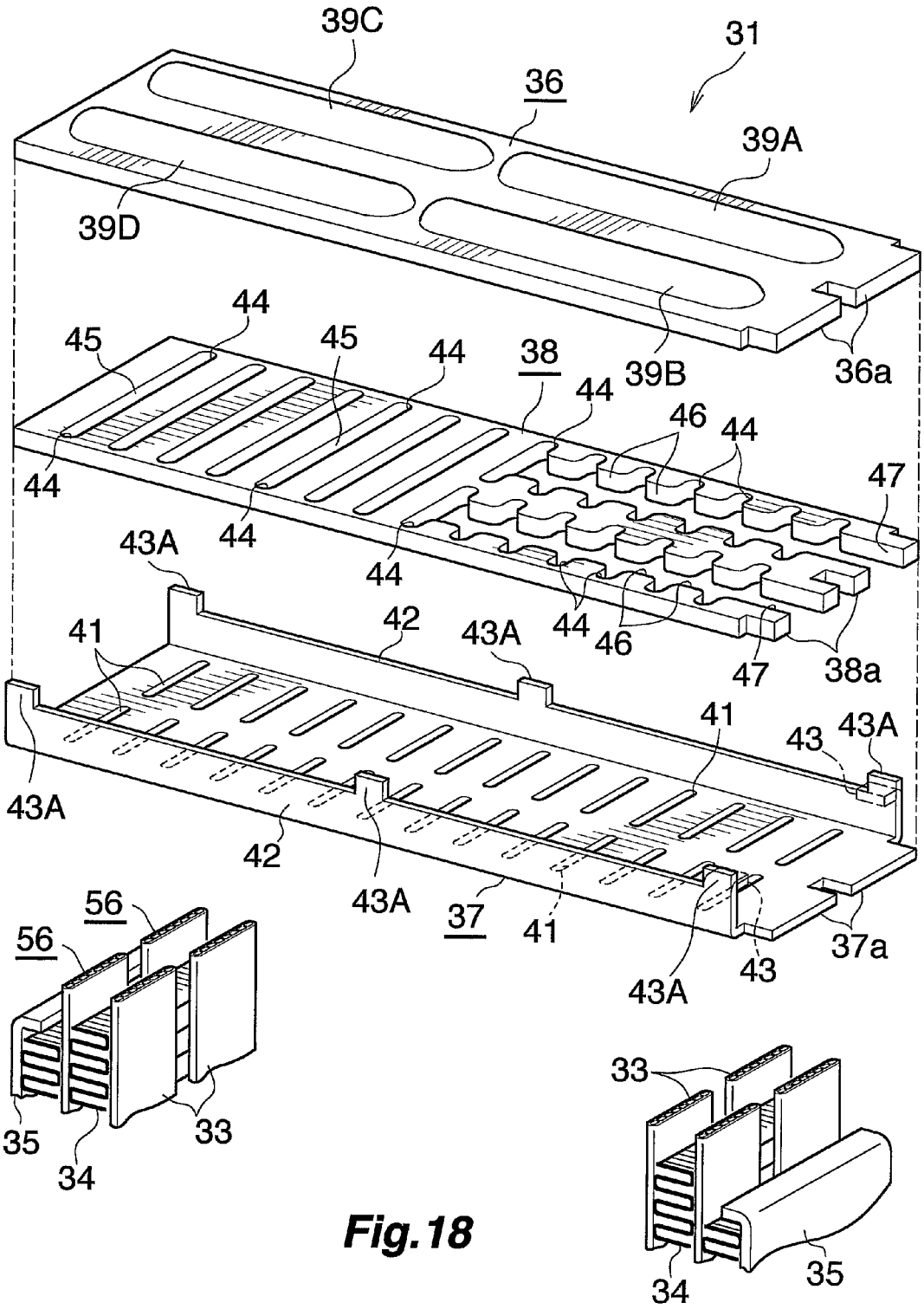
FIG. 18 is an exploded perspective view showing the first header tank of the evaporator of FIG. 10.
Figure 19:
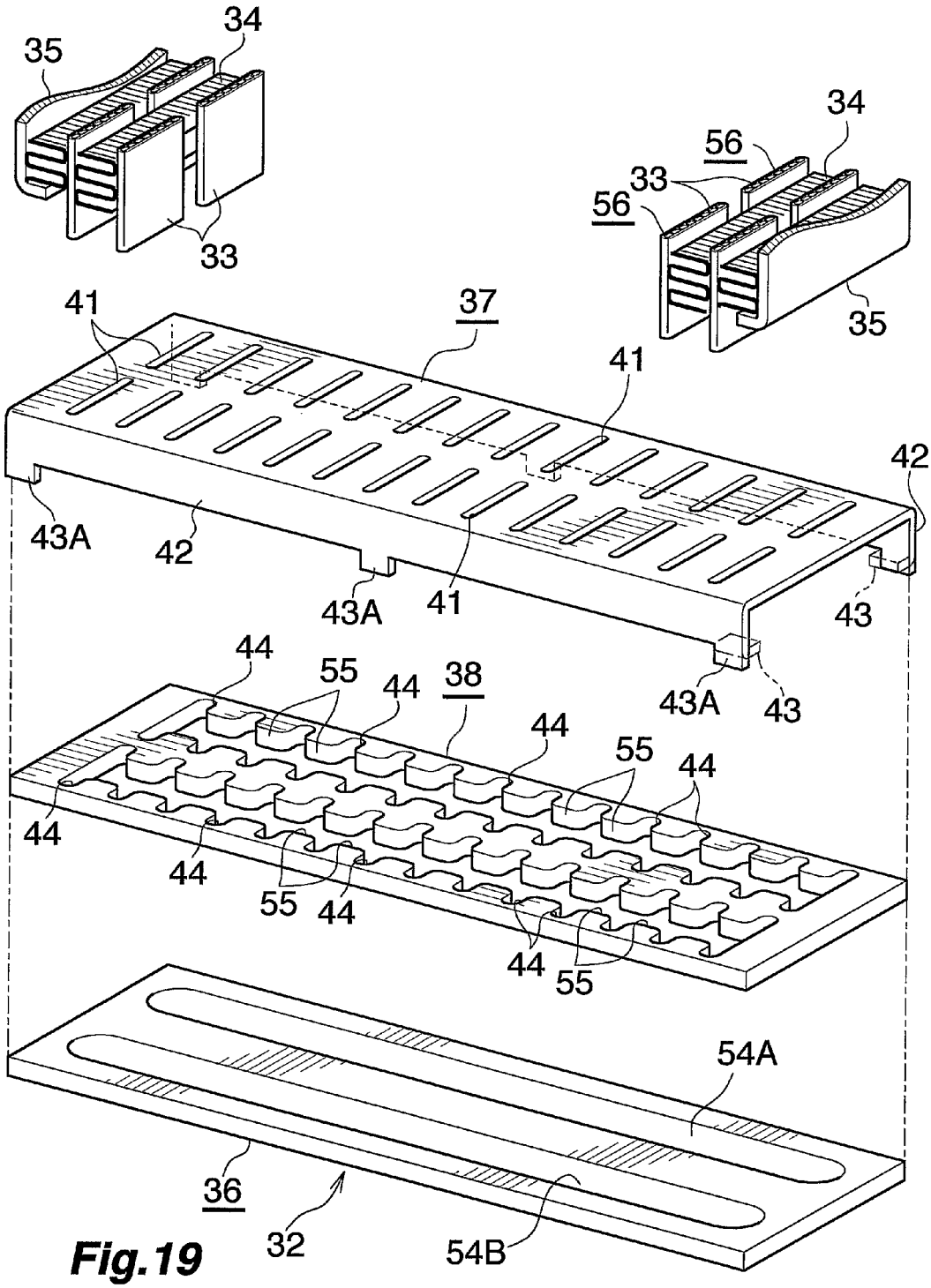
FIG. 19 is an exploded perspective view showing a second header tank of the evaporator of FIG. 10.

The header tanks 31, 32 are made in the manner shown in FIGS. 18 and 19.

First, an aluminum brazing sheet having a brazing material layer over opposite surfaces thereof is subjected to press work to make header forming brazing plates 36 having outward bulging portions 39A to 39D, or 54A, 54B. Tube connecting plate 37 each having tube insertion holes 41, cover walls 42 and engaging portion forming lugs 43A extending straight from each of the cover walls 42 are made from an aluminum brazing sheet having a brazing material layer over opposite surfaces thereof by press work. Intermediate plates 38 having communication holes 44, and communication portions 45, 46, or 55 are further made from a bare aluminum material by press work. Rightward projections 36*q*, 47*a*, 48*a* and cutouts 47 are formed on or in the header forming plate 36, intermediate plate 38 and tube connecting plate 37 for the first header tank 31.

The three plates 36, 37, 38 for each of the header tanks 31, 32 are then fitted together in superposed layers, the lugs 43A are thereafter bent to form engaging portions 43, and the engaging portions 43 are caused to engage with the header forming plate 36. In this way, each of two tacked assemblies are obtained. Utilizing the brazing material layers of the plates 36, 37, the three plates 36, 37, 38 of each assembly are then brazed to one another, the cover walls 42 are brazed to the front and rear side faces of the intermediate plate 38 and header forming plate 36, and the engaging portions 43 are brazed to the plate 36. Thus, the two header tanks 31, 32 are made.

Each of the heat exchange tubes 4 is made from a metal extrudate, i.e., an aluminum extrudate in the present embodiment, is in the form of a flat tube having an increased width in the front-rear direction and has inside thereof a plurality of refrigerant channels 33*a* extending longitudinally thereof and arranged in parallel. The heat exchange tubes 33 are brazed to the tube connecting plates 37 of the two header tanks 31, 32 using the brazing material layers of the plates 37, with their opposite ends placed into the respective tube insertion holes 41 of the tanks 31, 32. Each end of the tube 33 is placed into the communication hole 44 of the intermediate plate 38 to an intermediate portion of the thickness thereof (see FIG. 12). Between the two header tanks 31, 32, a plurality of tube groups 56, each comprising a plurality of heat exchange tubes 33 arranged in parallel in the left-right direction at a spacing, are arranged in rows, i.e., in two rows as spaced apart in the front-rear direction. The heat exchange tubes 33 positioned in the right half of the front tube group 56 have upper and lower ends which are joined to the respective header tanks 31, 32 so as to communicate with the interior of the first bulging portion 39A and the interior of the front bulging portion 54A. The heat exchange tubes 33 positioned in the left half of the front tube group 56 have upper and lower ends which are joined to the respective header tanks 31, 32 so as to communicate with the interior of the third bulging portion 39C and the interior of the front bulging portion 54A. The heat exchange tubes 33 positioned in the right half of the rear tube group 56 have upper and lower ends which are joined to the respective header tanks 31, 32 so as to communicate with the interior of the second bulging portion 39B and the interior of the rear bulging portion 54B. The heat exchange tubes 33 positioned in the left half of the rear tube group 56 have upper and lower ends which are joined to the respective header tanks 31, 32 so as to communicate with the interior of the fourth bulging portion 39D and the interior of the rear bulging portion 54B.

Each of the corrugated fins 34 is made in a wavy form from an aluminum brazing sheet having a brazing material layer over opposite surfaces thereof. Connecting portions interconnecting crest portions and furrow portions of the fin are provided with a plurality of louvers arranged in parallel in the front-rear direction. The corrugated fin 34 is used in common for the front and rear tube groups 56 and has a front-to-rear width which is approximately equal to the distance from the front edge of heat exchange tube 33 of the front tube group 56 to the rear edge of the corresponding heat exchange tube 33 of the rear tube group 56. Instead of using one corrugated fin 34 for the front and rear tube groups 56 in common, a corrugated fin may be provided between each adjacent pair of heat exchange tubes 33 in each of the tube groups 56.

The evaporator 30 is fabricated by preparing the above-mentioned two tacked assemblies for making two header tanks 31, 32, heat exchanges tubes 33 and corrugated fins 34; arranging the two tacked assemblies as spaced apart with their tube connecting plates 37 opposed to each other; arranging the heat exchange tubes 33 and the corrugated fins 34 alternately; inserting opposite ends of the heat exchange tubes 33 into the respective tube insertion holes 41 of the tube connecting plates 37 of the two tacked assemblies; arranging side plates 35 externally of the respective corrugated fins 34 at opposite ends of the resulting arrangement; arranging a refrigerant inlet-outlet member 51 as opposed to all the three plates 36, 37, 38 for the header tank 31 to be made; and brazing the three plates 36, 37, 38 of each tacked assembly to make header tanks 31, 32, and brazing the heat exchange tubes 33 to the header tanks 31, 32, each fin 34 to the heat exchange tubes 33 adjacent thereto, each side plate 35 to the fin 34 adjacent thereto, and the inlet-outlet member 51 to the first header tank 31 simultaneously with the brazing of each tacked assembly.

The evaporator 30 provides a supercritical refrigeration cycle along with a compressor, evaporator, pressure reducing device and an intermediate heat exchanger for subjecting the refrigerant flowing out from a gas cooler and the refrigerant flowing out from the evaporator to heat exchange, and the refrigeration cycle is installed in vehicles, for example, in motor vehicles, as a motor vehicle air conditioner.

Figure 20:
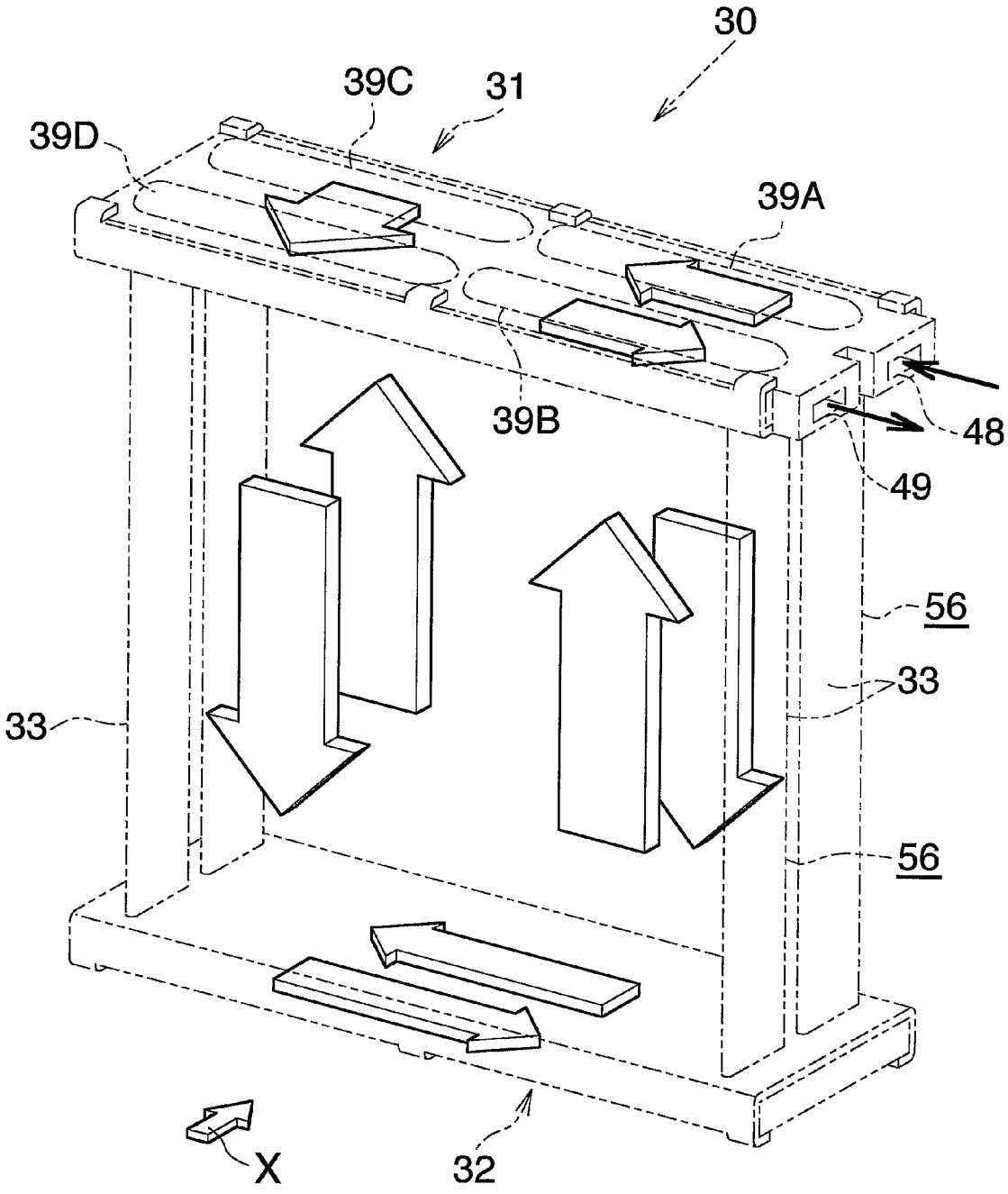
FIG. 20 is a diagram showing the flow of a refrigerant through the evaporator of FIG. 10.

With the evaporator 30 described above, $CO_2$ passing through an expansion valve flows through the refrigerant inflow channel 52 of the inlet-outlet member 51, then flows through the inlet 48 into the first outward bulging portion 39A of the first header tank 31, and thereafter dividedly flows into the refrigerant channels 33*a* of all the heat exchange tubes 33 in communication with the interior of the first bulging portion 39A as shown in FIG. 20. The $CO_2$ in the channels 33*a* flows down the channels 33*a* and enters the front outward bulging portion 54A of the second header tank 32. The $CO_2$ in the portion 54A flows leftward through this portion 54A and the communication portions 55 of the intermediate plate 38, then dividedly flows into the channels 33*a* of all the heat exchange tubes 33 in communication with the interior of the third outward bulging portion 39C, changes its course, flows upward through the channels 33*a* and enters the third outward bulging portion 39C of the first header tank 31. The $CO_2$ in the bulging portion 39C flows through the first communication portions 45 of the intermediate plate 38 of the first header tank 31 into the fourth outward bulging portion 39D, dividedly flows into the channels 33*a* of all the heat exchange tubes 33 communicating with the fourth bulging portion 39D, changes its course, flows down the channels 33*a* and enters the rear outward bulging portion 54B of the second header tank 32. The $CO_2$ then flows rightward through this portion 54B and the communication portions 55 of the intermediate plate 38, dividedly flows into the channels 33*a* of all the heat exchange tubes 33 communicating with the second outward bulging portion 39B, changes its course, flows up the channels 33*a* and enters the second outward bulging portion 39B of the first header tank 31. The $CO_2$ thereafter flows out of the evaporator 30 via the outlet 49 and the outflow channel 53 of the inlet-outlet member 51. While flowing through the channels 33*a* of the heat exchange tubes 33, the $CO_2$ is subjected to heat exchange with the air flowing through the air passing clearances in the direction of arrows X shown in FIGS. 10 and 20 and flows out from the evaporator in a vapor phase.

Although $CO_2$ is used as the supercritical refrigerant of the supercritical refrigeration cycle according to the foregoing two embodiments, the refrigerant is not limitative but ethylene, ethane, nitrogen oxide or the like is alternatively used.

FIGS. 21 to 25 show modified heat exchange tubes for use in the gas cooler 1 of Embodiment 1 and in the evaporator 30 of embodiment 2 described.

Figure 21:
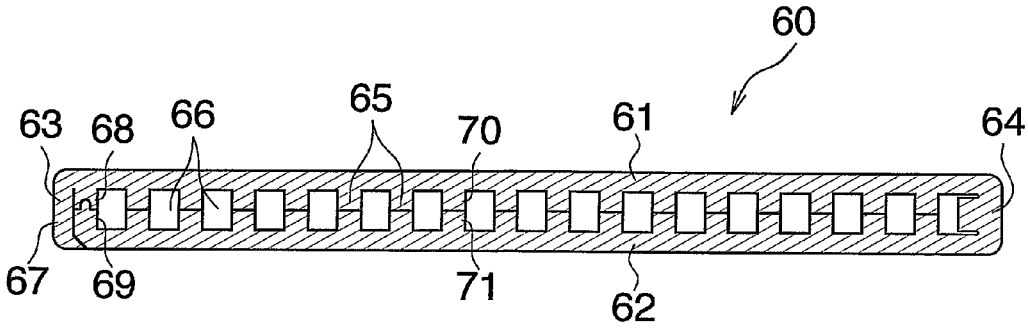
FIG. 21 is a view in cross section showing a first modification of heat exchange tube.
Figure 22:
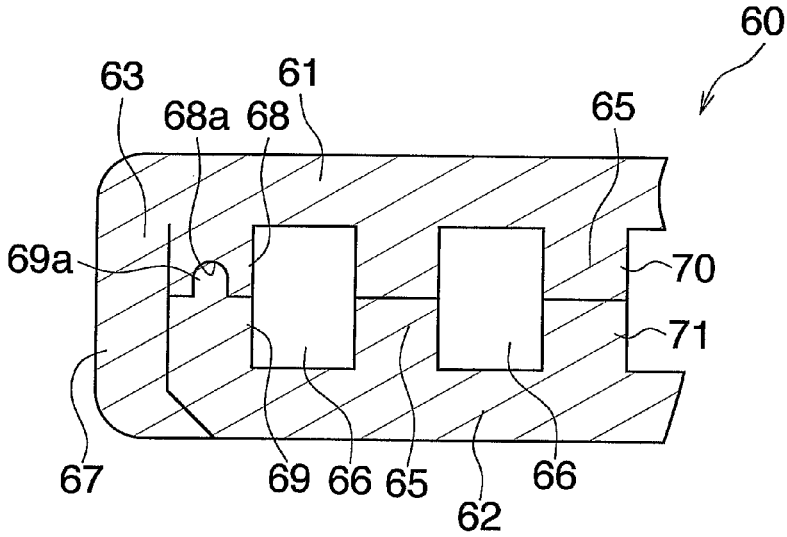
FIG. 22 is a fragmentary enlarged view of FIG. 21.

FIGS. 21 and 22 show a heat exchange tube 60 which comprises a pair of upper and lower flat walls 61, 62 (a pair of flat walls) opposed to each other, left and right opposite side walls 63, 64 interconnecting the upper and lower walls 61, 62 at their left and right side edges, and a plurality of reinforcing walls 65 interconnecting upper and lower walls 61, 62 between opposite side walls 63, 64, extending longitudinally of the tube and spaced from one another by a predetermined distance. The tube 60 has in its interior a plurality of refrigerant channels 66 arranged widthwise thereof in parallel. The reinforcing wall 65 serves as a partition wall between each adjacent pair of refrigerant channels 66. The channels 66 are equal in width over the entire height thereof.

The left side wall 63 has a double structure and comprises an outer side wall ridge 67 projecting downward from the left side edge of the upper wall 61 integrally therewith and extending over the entire height of the tube 60, an inner side wall ridge 68 projecting downward from the upper wall 61 integrally therewith and positioned inside the ridge 67, and an inner side wall ridge 69 projecting upward from the left side edge of the lower wall 62 integrally therewith. The outer side wall ridge 67 is brazed to the two inner side wall ridges 68, 69 and to the lower wall 62, with a lower end portion of the ridge 67 in engagement with a lower surface left side edge of the lower wall 62. The two inner side wall ridges 68, 69 are butted against and brazed to each other. The right side wall 64 is integral with the upper and lower walls 61, 62. The inner side wall ridge 69 of the lower wall 62 is provided on the top end face thereof with a projection 69*a* extending over the entire length thereof integrally therewith. The inner side wall ridge 68 of the upper wall is provided in the lower end face thereof with a groove 68*a* extending over the entire length thereof for the projection 69*a* to be forced in by a press fit.

Each reinforcing wall 65 comprises a reinforcing wall ridge 70 projecting downward from the upper wall 61 integrally therewith, and a reinforcing wall ridge 71 projecting upward from the lower wall 62 integrally therewith, and is formed by butting these ridges 70, 71 against each other and brazing the ridges 70. 71 to each other.

Figure 23:
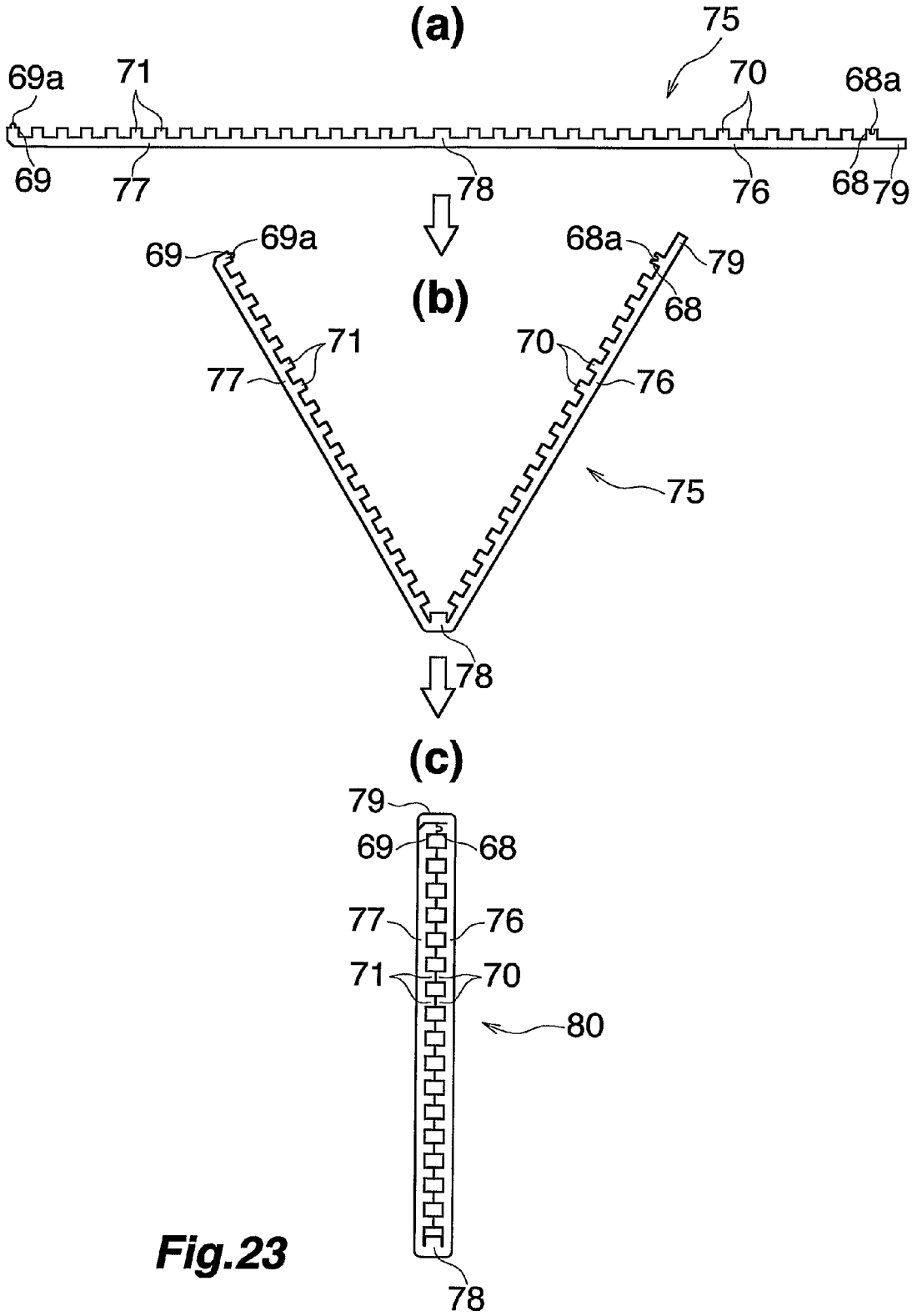
FIG. 23 is a diagram showing a process for fabricating the heat exchange tube of FIG. 21.

The heat exchange tube 60 is fabricated from a tube making metal plate 75 as shown in FIG. 23(*a*). The metal plate 75 is made of an aluminum brazing sheet having a brazing material layer over opposite surfaces thereof, and comprises a flat upper wall forming portion 76 (flat wall forming portion), a flat lower wall forming portion 77 (flat wall forming portion), a connecting portion 78 interconnecting the upper and lower wall forming portions 76, 77 for making the right side wall 64, inner side wall ridges 68, 69 integrally projecting upward respectively from the upper wall forming portion 76 and the lower wall forming portion 77 each at a side edge thereof opposite to the connecting portion 78 for making the inner portion of the left side wall 63, an outer side wall ridge forming portion 79 formed by extending the upper wall forming portion 76 rightwardly outward at a side edge (right side edge) thereof opposite to the connecting portion 78, and a plurality of reinforcing wall ridges 70, 71 projecting upward respectively from the upper wall forming portion 76 and the lower wall forming portion 77 integrally therewith and arranged at a predetermined spacing in the left-right direction. The reinforcing wall ridges 70 on the upper wall forming portion 76 and the reinforcing wall ridges 71 on the lower wall forming portion 77 are symmetrical about a widthwise center line of the connecting portion 78. A projection 69*a* is formed on the top end of the inner side wall ridge 69 on the lower wall forming portion 77, and a groove 68*a* is formed in the top end of the inner side ridge 68 on the upper wall forming portion 76. The inner side wall ridges 68, 69 and all the reinforcing wall ridges 70*m* 71 are equal in height. The vertical thickness of the connecting portion 78 is larger than the thickness of the upper and lower wall forming portions and is approximately equal to the height of projection of the reinforcing wall ridges 70, 71.

Since the side wall ridges 68, 69 and the reinforcing wall ridges 70, 71 are formed integrally on one surface of an aluminum brazing sheet which is clad with a brazing material layer over opposite surfaces thereof, a brazing material layer (not shown) is formed on opposite side faces and the top end faces of the ridges 68, 69 and the ridges 70, 71, and on the upper and lower surfaces of the upper and lower wall forming portions 76, 77. The brazing material layer on the end faces of the ridges 68, 69 and the reinforcing wall ridges 70, 71 has a larger thickness than the brazing material layer on the other portions.

The tube making metal plate 75 is progressively folded at the left and right opposite side edges of the connecting portion 78 by roll forming [see FIG. 23(*b*)], and is finally folded into a hairpin form to butt the inner side wall ridges 68, 69, as well as each corresponding pair of reinforcing wall ridges 70, 71, against each other and to force the projection 69*a* into the groove 68*a* by a press fit.

Subsequently, the outer side wall ridge forming portion 79 is folded onto the outer surface of the inner side wall ridges 68, 69, and the outer end of the portion 79 is deformed into engagement with the lower wall forming portion 77 to obtain a folded body 80 [see FIG. 23(*c*)].

The folded body 80 is thereafter heated at a predetermined temperature to braze the opposed ends of the inner side wall ridges 68, 69 to each other and the opposed ends of each corresponding pair of reinforcing wall ridges 70, 71 to each other, and the outer side wall ridge forming portion 79 is brazed to the inner side wall ridges 68, 69 and to the lower wall forming portion 77, whereby a heat exchange tube 60 is fabricated. The tube 60 is made simultaneously with the fabrication of the gas cooler 1 or the evaporator 30.

Figure 24:
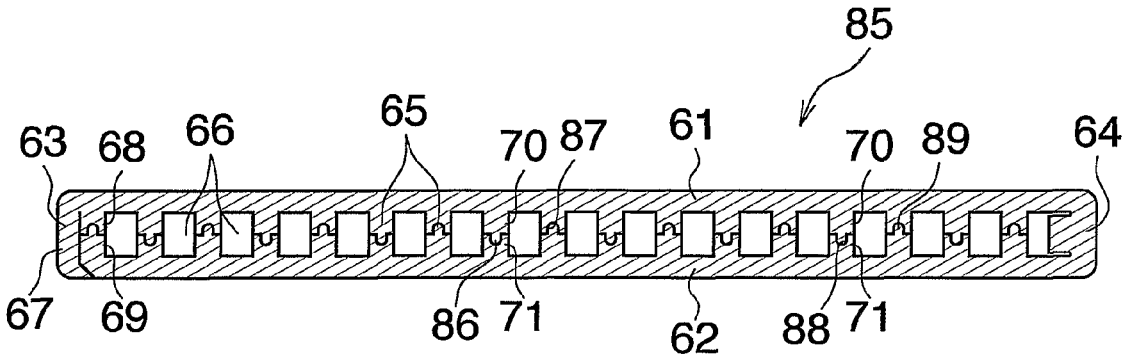
FIG. 24 is a view in cross section showing a second modification of heat exchange tube.

FIG. 24 shows a heat exchange tube 85 wherein the end faces of all reinforcing wall ridges 70 on an upper wall 61 are alternately provided with projections 86 extending over the entire length thereof and grooves 87 extending over the entire length thereof. Further the end faces of all reinforcing wall ridges 71 on the lower wall 62 are alternately provided with grooves 88 for the respective projections 86 of the ridges 70 on the upper wall 61 to be butted thereagainst to fit in, and projections 89 to be fitted into the respective grooves 87 in the reinforcing wall ridges 70 on the upper wall 61, the grooves 88 and the projections 89 extending over the entire length of the tube. With the exception of this feature, the tube 85 has the same construction as the tube 60 shown in FIGS. 21 and 22. The tube 85 is fabricated by the same process as the tube 60 shown in FIGS. 21 and 22.

Figure 25:
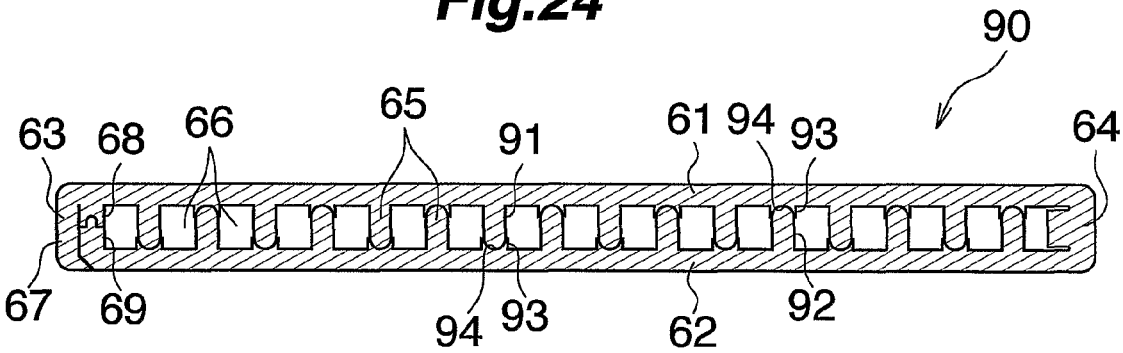
FIG. 25 is a view in cross section showing a third modification of heat exchange tube.
Figure 26:
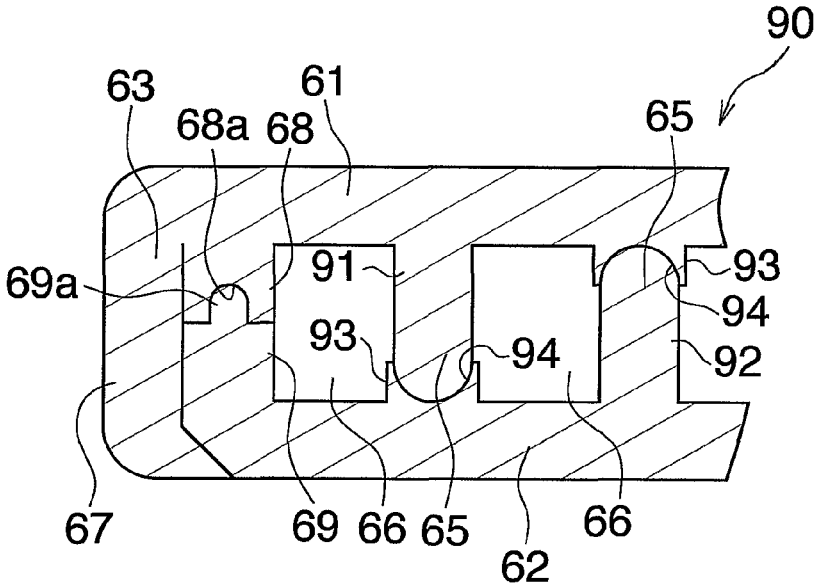
FIG. 26 is an enlarged fragmentary view of FIG. 25.

FIGS. 25 and 26 show a heat exchange tube 90, which has reinforcing walls 65 each comprising a reinforcing wall ridge 91 projecting downward from an upper wall 61 integrally therewith and brazed to a lower wall 62, and reinforcing walls 65 each comprising a reinforcing wall ridge 92 projecting upward from the lower wall 62 and brazed to the upper wall 61, the former reinforcing walls 65 and the latter reinforcing wall being arranged alternately in the left-right direction. The portions of one of the upper walls 61, 62 where the reinforcing wall ridges 92 or 91 of the other wall are brought into contact with the wall are each provided with a protrusion 93, the end face of which is provided with a groove 94 for the end of the ridge 91 or 92 to fit in. The end of the ridge 91 or 92 is fitted in the groove 94 of the protrusion 93 and brazed to the protrusion 93. The left-to-right thickness of the protrusion 93 is slightly larger than the left-to-right thickness of the reinforcing wall ridge 91 or 92. With the exception of the feature described above, the tube 90 has the same construction as the heat exchange tube 60 shown in FIGS. 21 and 22. The heat exchange tube 90 has refrigerant channels 66 having a width varying in the direction of height thereof, and the term "minimum channel width Wp" refers to the smallest width at the same level, i.e., the spacing between the protrusions 93 to which one of the ridge 91 and 92 and the ridge 92 or 91 adjacent thereto are brazed. Further the thickness of the reinforcing wall ridge 91 or 92 forming the reinforcing wall 65 will be referred to as the thickness of the partition between each adjacent pair of refrigerant channels 66.

Figure 27:
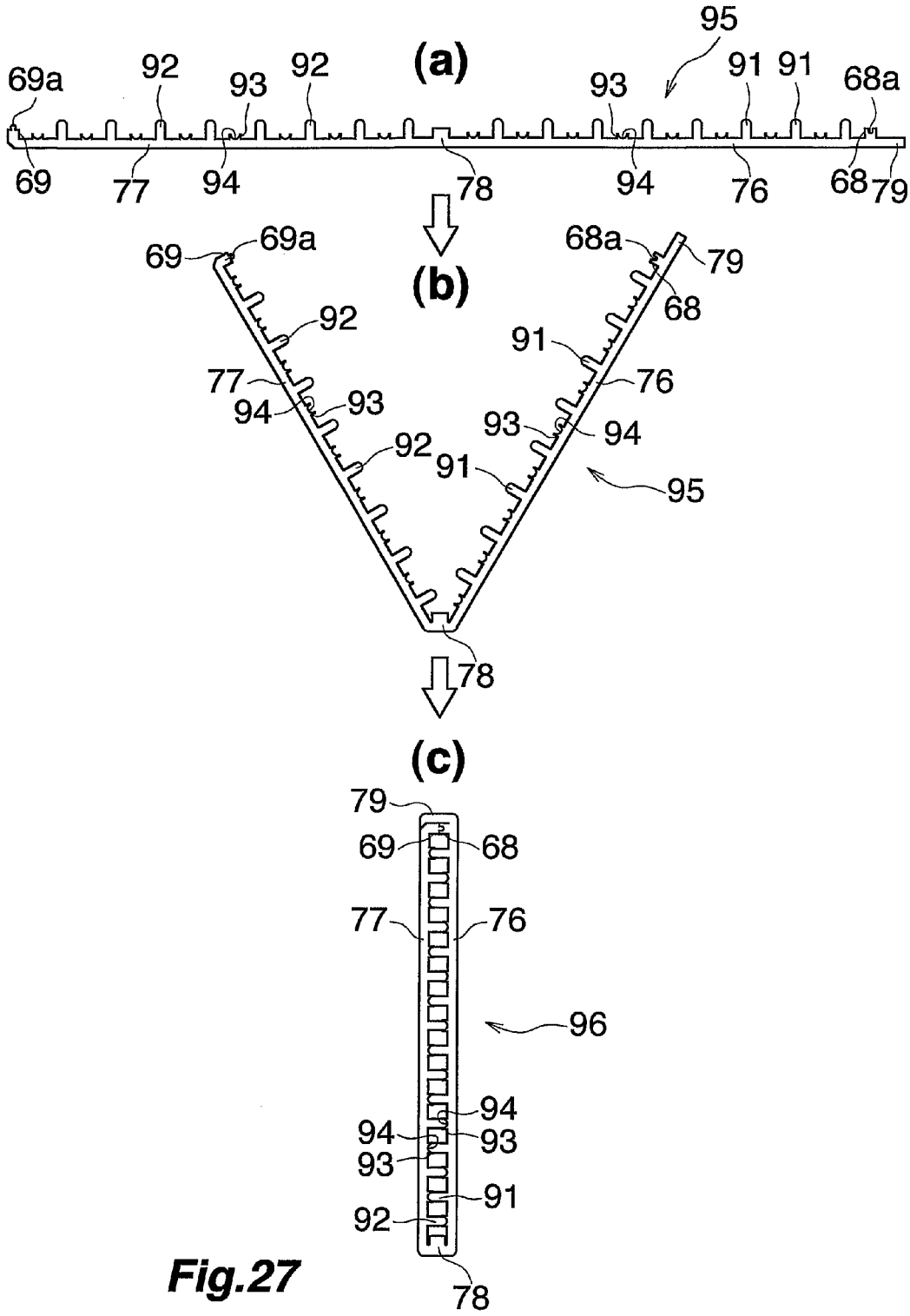
FIG. 27 is a diagram showing a process for fabricating the heat exchange tube of FIG. 25.

The heat exchange tube 90 is fabricated from a tube making metal plate 95 as shown in FIG. 27(*a*). The metal plate 95 is made of an aluminum brazing sheet having a brazing material layer over opposite surfaces thereof, and comprises a plurality of reinforcing wall ridges 91, 92 projecting upward respectively from an upper wall forming portion 78 and a lower wall forming portion 77 integrally therewith and arranged in the left-right direction at a predetermined spacing. The ridges 91 on the upper wall forming portion 76 and the ridges 92 on the lower wall forming portion 77 are so positioned as to be symmetrical about the widthwise center line of a connecting portion 78. The ridges 91, 92 are equal in height, and the height thereof is approximately twice the height of the side wall ridges 68, 69. The areas of the upper wall forming portion 76 and the lower wall forming portions 77 where the reinforcing wall ridges 92, 91 of the portions 77 and 76 bear on are each integrally provided with a protrusion 93 extending over the entire length, and a groove 94 is formed in the end of the protrusion 93 for the end of the ridge 92 or 91 to fit in. With the exception of the above feature, the tube making metal plate 95 has the same construction as the metal plate 75 shown in FIG. 23.

The tube making metal plate 95 is progressively folded at the left and right opposite side edges of the connecting portion 78 by roll forming [see FIG. 27(*b*)], and is finally folded into a hairpin form to butt the inner side wall ridges 68, 69 against each other to force the projection 69*a* into the groove 68*a* by a press fit, and to fit the ends of the reinforcing wall ridges 91 on the upper wall forming portion 76 into the corresponding grooves 94 in the protrusions 93 on the lower wall forming portion 77, and ends of the reinforcing wall ridges 92 on the lower wall forming portion 77 into the corresponding grooves 94 in the protrusions 93 on the upper wall forming portion 76.

Subsequently, the outer side wall ridge forming portion 79 is folded onto the outer surface of the inner side wall ridges 68, 69, and the outer end of the portion 79 is deformed into engagement with the lower wall forming portion 77 to obtain a folded body 96 [see FIG. 27(*c*)].

The folded body 96 is thereafter heated at a predetermined temperature to braze the opposed ends of the inner side wall ridges 68, 69 to each other and the ends of the reinforcing wall ridges 91, 92 to the protrusions 93, and the outer side wall ridge forming portion 79 is brazed to the inner side wall ridges 68, 69 and to the lower wall forming portion 77, whereby a heat exchange tube 90 is fabricated. The tube 90 is made simultaneously with the fabrication of the gas cooler 1 or the evaporator 30.

INDUSTRIAL APPLICABILITY

The heat exchange header tank of the invention and the heat exchanger comprising the header tank are useful for gas coolers or evaporators, for example, for use in supercritical refrigeration cycles wherein $CO_2$ (carbon dioxide) or like supercritical refrigerant is used.

The invention claimed is:

1. A heat exchanger comprising a pair of header tanks arranged as spaced apart from each other; and a plurality of heat exchange tubes arranged in parallel between the pair of header tanks and each having opposite ends joined to the respective header tanks, each of the heat exchanger header tanks comprising a header forming plate, a tube connecting plate and an intermediate plate interposed between the two plates, the header forming plate, the tube connecting plate and the intermediate plate being arranged in superposed layers and brazed to one another, the header forming plate being provided with an outward bulging portion extending longitudinally thereof and having an opening thereof closed with the intermediate plate, the tube connecting plate being provided at a portion thereof corresponding to the outward bulging portion with a plurality of tube insertion holes arranged longitudinally of the tube connecting plate at a spacing and extending through the thickness thereof, the intermediate plate having communication holes extending through the thickness thereof for causing the respective tube insertion holes of the tube connecting plate to communicate with interior of the outward bulging portion of the header forming plate therethrough, the heat exchange tubes having their opposite ends inserted into the respective tube insertion holes of the pair of header tanks and brazed to the respective header tanks, wherein the header forming plate of the first of the pair of header tanks has a plurality of outward bulging portions aligned longitudinally thereof and spaced apart from each other, and the header forming plate of the second of the pair of header tanks has outward bulging portions one smaller in number to the number of outward bulging portions of the first header tank so as to be opposed to adjacent two outward bulging portions of the first header tank, all the communication holes of the intermediate plate of the first header tank in communication with each of the outward bulging portions of the first header tank are held in communication by communication portions formed in the intermediate plate, all the communication holes of the intermediate plate of the second header tank in communication with each of the outward bulging portions of the second header tank are held in communication by communication portions formed in the intermediate plate, the first header tank has a refrigerant inlet communicating with the outward bulging portion at one end thereof and a refrigerant outlet communicating with the outward bulging portion at the other end thereof, the header forming plate of each of the header tanks has a wall thickness T, the outward bulging portion of each header tank has a bulging height of H, and H/T is in the range of 0.5 to 1.5.

2. A heat exchanger according to claim 1 wherein the header forming plate, the tube connecting plate and the intermediate plate are each made from a metal plate by press work.

3. A heat exchanger according to claim 1 wherein the tube connecting plate is integrally provided at each of opposite side edges thereof with a cover wall covering a boundary between the header forming plate and the intermediate plate over the entire length thereof, and the cover wall is brazed to corresponding side faces of the header forming plate and the intermediate plate.

4. A heat exchanger according to claim 3 wherein the cover wall is integrally provided at an outer end thereof with an engaging portion engaged with an outer surface of the header forming plate and brazed to the header forming plate.

5. A heat exchanger according to claim 1 wherein the first header tank is two in the number of outward bulging portions therein, and the second header tank is one in the number of outward bulging portion therein.

6. A supercritical refrigeration cycle which comprises a compressor, a gas cooler, an evaporator, a pressure reducing device and an intermediate heat exchanger for subjecting refrigerant flowing out from the gas cooler and refrigerant flowing out from the evaporator to heat exchange, and wherein a supercritical refrigerant is used, the gas cooler comprising a heat exchanger according to claim 1.

7. A vehicle having installed therein a supercritical refrigeration cycle according to claim 6 as a vehicle air conditioner.

8. A heat exchanger comprising:

a pair of header tanks arranged as spaced apart from each other; and a plurality of heat exchange tubes arranged in parallel between the pair of header tanks and each having opposite ends joined to the respective header tanks, each of the heat exchanger header tanks comprising a header forming plate, a tube connecting plate and an intermediate plate interposed between the two plates, the header forming plate, the tube connecting plate and the intermediate plate being arranged in superposed layers and brazed to one another, the header forming plate being provided with an outward bulging portion extending longitudinally thereof and having an opening thereof closed with the intermediate plate, the tube connecting plate being provided at a portion thereof corresponding to the outward bulging portion with a plurality of tube insertion holes arranged longitudinally of the tube connecting plate at a spacing and extending through the thickness thereof, the intermediate plate having communication holes extending through the thickness thereof for causing the respective tube insertion holes of the tube connecting plate to communicate with interior of the outward bulging portion of the header forming plate therethrough, the heat exchange tubes having their opposite ends inserted into the respective tube insertion holes of the pair of header tanks and brazed to the respective header tanks, wherein the header forming plate of the first of the pair of header tanks has four outward bulging portions arranged widthwise thereof at a spacing and longitudinally thereof at a spacing, the header forming plate of the second of the pair of header tanks has two outward bulging portions arranged side by side as spaced apart widthwise thereof and opposed to the respective longitudinally adjacent pairs of outward bulging portions of the first header tank, the tube connecting plate of each of the header tanks is provided with a plurality of tube insertion holes at each of widthwise opposite side portions thereof, the intermediate plate of each header tank is provided with a plurality of communication holes at each of widthwise opposite side portions thereof, the communication holes of the intermediate plate of the first header tank in communication with one of the pair of outward bulging portions arranged widthwise of the first header tank and the communication holes of the intermediate plate in communication with the other outward bulging portion of said pair are held in communication by first communication holes formed in the intermediate plate to thereby cause said pair of outward bulging portions to communicate with each other, all the communication holes of the intermediate plate communicating with the other pair of outward bulging portions are held in communication by second communication portions formed in the intermediate plate, all the communication holes of the intermediate plate of the second header tank in communication with each of the outward bulging portions of the second header tank are held in communication by communication portions formed in the intermediate plate, the first header tank is provided with a refrigerant inlet communicating with one of said other pair of outward bulging portions and a refrigerant outlet communicating with the other outward bulging portion of said other pair, the header forming plate of each of the header tanks has a wall thickness T, the outward bulging portions of each header tank have a bulging height of H, and H/T is in the range of 1.0 to 2.0.

9. A supercritical refrigeration cycle which comprises a compressor, a gas cooler, an evaporator, a pressure reducing device and an intermediate heat exchanger for subjecting refrigerant flowing out from the gas cooler and refrigerant flowing out from the evaporator to heat exchange, and wherein a supercritical refrigerant is used, the evaporator comprising a heat exchanger according to claim 8.

10. A vehicle having installed therein a supercritical refrigeration cycle according to claim 9 as a vehicle air conditioner.

* * * * *